US009792890B2

(12) United States Patent
Yoshino et al.

(10) Patent No.: US 9,792,890 B2
(45) Date of Patent: Oct. 17, 2017

(54) ELECTRONIC PERCUSSION INSTRUMENT

(71) Applicant: Roland Corporation, Shizuoka (JP)

(72) Inventors: Kiyoshi Yoshino, Shizuoka (JP); Ryo Takasaki, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 15/291,080

(22) Filed: Oct. 12, 2016

(65) Prior Publication Data

US 2017/0116972 A1 Apr. 27, 2017

(30) Foreign Application Priority Data

Oct. 23, 2015 (JP) ..... 2015-209156

(51) Int. Cl.

| | |
|---|---|
| ***G10H 3/12*** | (2006.01) |
| ***G10H 3/14*** | (2006.01) |
| ***G10D 13/02*** | (2006.01) |
| ***G10H 1/22*** | (2006.01) |

(52) U.S. Cl.

CPC ..... *G10H 3/146* (2013.01); *G10D 13/024* (2013.01); *G10H 1/22* (2013.01); *G10H 3/12* (2013.01); *G10H 2230/321* (2013.01)

(58) Field of Classification Search

CPC ..... G10H 3/12

USPC ..... 84/723

See application file for complete search history.

(56) References Cited

U.S. PATENT DOCUMENTS

| | | | | |
|---|---|---|---|---|
| 5,801,320 | A | 9/1998 | Segan et al. | |
| 2003/0188629 | A1* | 10/2003 | Suenaga | G10H 3/146 84/723 |
| 2005/0145101 | A1* | 7/2005 | Yoshino | G10H 1/32 84/723 |
| 2007/0137460 | A1* | 6/2007 | Mori | G10D 13/024 84/421 |
| 2007/0200466 | A1* | 8/2007 | Heim | B64C 33/02 310/311 |
| 2007/0200468 | A1* | 8/2007 | Heim | F04B 43/0054 310/311 |
| 2013/0000468 | A1 | 1/2013 | Wissmuller | |

(Continued)

FOREIGN PATENT DOCUMENTS

| | | |
|---|---|---|
| EP | 2790180 | 10/2014 |
| EP | 2889876 | 7/2015 |

(Continued)

OTHER PUBLICATIONS

Smartrigger, "Electronic Cymbal Products", retrieved Nov. 20, 2014 from http://www.smartrigger.com/products.html.

(Continued)

*Primary Examiner* — David Warren
(74) *Attorney, Agent, or Firm* — Jianq Chyun IP Office

(57) ABSTRACT

The disclosed electronic percussion instrument includes a plate-like pad that has a front surface to be struck, a sheet-like pressure sensor that is provided on a back surface of an outer circumferential end portion of the pad and that detects a pressure change, and a weight portion that contacts a front surface of the pressure sensor, wherein, due to striking on the front surface of the pad, an inertial force from the front surface of the pressure sensor toward a back surface of the pad acts on the weight portion, and the weight portion presses the pressure sensor.

18 Claims, 16 Drawing Sheets

(56) References Cited

U.S. PATENT DOCUMENTS

| | | | | |
|---|---|---|---|---|
| 2014/0053713 | A1* | 2/2014 | Truchsess | G10D 13/06 84/723 |
| 2014/0174282 | A1* | 6/2014 | Truchsess | G10H 3/146 84/723 |
| 2014/0260897 | A1 | 9/2014 | Miyashita | |
| 2015/0262567 | A1* | 9/2015 | Truchsess | G10H 1/32 84/725 |
| 2015/0269921 | A1* | 9/2015 | Truchsess | G10D 13/06 84/422.1 |
| 2015/0358737 | A1* | 12/2015 | Yang | H04R 17/00 367/180 |

FOREIGN PATENT DOCUMENTS

| | | |
|---|---|---|
| JP | H10-207452 | 8/1998 |
| JP | 2002-062872 | 2/2002 |
| JP | 2002-207481 | 7/2002 |
| JP | 2013-015852 | 1/2013 |
| JP | 2014-203037 | 10/2014 |

OTHER PUBLICATIONS

Smartrigger, "Electronic Cymbal Products Users Guide", Feb. 10, 2010, pp. 1-22.

"Partial Search Report of Europe Counterpart Application" , dated Dec. 12, 2016, p. 1-p. 6, in which the listed references were cited.

"Search Report of European Counterpart Application", dated Mar. 20, 2017, p. 1-p. 9.

* cited by examiner

ELECTRONIC PERCUSSION INSTRUMENT

CROSS-REFERENCE TO RELATED APPLICATION

This application claims the priority benefit of Japanese patent application no. 2015-209156, filed on Oct. 23, 2015. The entirety of the above-mentioned patent application is hereby incorporated by reference herein and made a part of this specification.

BACKGROUND OF THE INVENTION

Field of the Invention

The invention relates to an electronic percussion instrument and a struck position detector, particularly to an electronic percussion instrument and a struck position detector capable of improving detection accuracy for a strike.

Description of Related Art

In an electronic percussion instrument such as an electronic cymbal or an electronic hi-hat cymbal, a technique is known of detecting a position struck by a stick or the like by a strike sensor, controlling a sound source based on the struck position, and producing a musical sound. For example, there is disclosed an electronic cymbal including a vibration sensor, a pressure sensor and a rubber cover (Patent Literature 1), wherein the vibration sensor is provided on a central portion of a pad, the pressure sensor is provided on an outer circumferential end portion of the pad, and the rubber cover covers the outer circumferential end portion of the pad and the pressure sensor. In Patent Literature 1, if only the vibration sensor generates an output, it is determined that the central portion of the pad is struck. In addition, in Patent Literature 1, if the vibration sensor and the pressure sensor both generate an output, it is determined that the outer circumferential end portion of the pad is struck.

However, in Patent Literature 1, the rubber cover that covers the outer circumferential end portion of the pad and the pressure sensor is deformed by the striking on the outer circumferential end portion, thereby pressing the pressure sensor. Thus, in order for the pressure sensor to stably operate, a rubber cover having a certain thickness and/or hardness is required. For that reason, if the outer circumferential end portion is weakly struck (when a weak strike occurs thereon), the rubber cover is less likely to deform. Accordingly, sometimes the output from the pressure sensor cannot be obtained.

PRIOR-ART LITERATURE

Patent Literature

[Patent Literature 1] Japanese Patent Publication No. 2013-15852

SUMMARY OF THE INVENTION

The invention has been accomplished in order to solve the above problem. Particularly, an object of the invention is to provide an electronic percussion instrument and a struck position detector capable of improving detection accuracy for a strike.

To achieve the above, according to an electronic percussion instrument of a technical solution, on a back surface of an outer circumferential end portion of a plate-like pad having a front surface to be struck, a sheet-like pressure sensor that detects a pressure change is provided, wherein a front surface of the pressure sensor contacts a weight portion. Due to striking on the front surface of the pad, an inertial force from the front surface of the pressure sensor toward a back surface of the pad acts on the weight portion, and the weight portion presses the pressure sensor. Even when a weak strike occurs on the outer circumferential end portion, a predetermined inertial force acts on the weight portion to press the pressure sensor. Thus, when a weak strike occurs, the pressure sensor is still able to detect a pressure change. Accordingly, an effect is obtained that detection accuracy of the pressure sensor for a strike can be improved.

If a central portion is struck, swinging of the outer circumferential end portion is smaller than if the outer circumferential end portion is struck. Thus, the inertial force acting on the weight portion can be reduced. Hence, a pressing force toward the pressure sensor caused by the inertial force acting on the weight portion can be reduced, and the pressure sensor can be made less likely to detect a pressure change. Thus, an effect is obtained that erroneous detection of the pressure sensor in the case where the central portion is struck can be suppressed.

According to the electronic percussion instrument of a technical solution, a connection portion fixed to the pad at a position closer to at least one of an outer circumferential end and a center of the pad than the pressure sensor is connected to the weight portion. Since the weight portion is nonadhesive to the pressure sensor, an adhesion layer formed of a cured adhesive can be prevented from forming between the pressure sensor and the weight portion. Accordingly, reduction in detection sensitivity of the pressure sensor caused by the adhesion layer can be prevented. Furthermore, the weight portion is nonadhesive to the pressure sensor, and the connection portion formed of an elastic material is deformed by bending. Accordingly, the pad and the pressure sensor can be suppressed from moving simultaneously with the weight portion, and the pressing force toward the pressure sensor caused by the inertial force acting on the weight portion can be ensured. As a result, an effect is obtained that the detection accuracy of the pressure sensor for a strike can be improved compared to the case where the weight portion is adhered to the pressure sensor.

According to the electronic percussion instrument of a technical solution, the weight portion is continuously provided along a shape of the pressure sensor extending along an outer circumference of the pad, and the weight portion is adhered to the front surface of the pressure sensor. Accordingly, installation of the weight portion can be facilitated and a structure of the weight portion can be simplified.

Since the weight portion is formed of an elastic material, a part of the weight portion continuously provided along the outer circumference of the pad can be elastically deformed. When struck, a part of the weight portion on which a maximum inertial force acts is elastically deformed, so as to press the pressure sensor. Accordingly, an effect is obtained that while the installation of the weight portion can be facilitated and the structure of the weight portion is simplified, the detection accuracy of the pressure sensor for a strike can be improved.

According to the electronic percussion instrument of a technical solution, the pressure sensor extends along the outer circumference of the pad, and the weight portion is intermittently provided along the shape of the pressure sensor. Accordingly, it can be suppressed that deformation of the part of the weight portion on which the maximum inertial force acts is hindered by the weight portion adjacent thereto.

Accordingly, an effect is obtained that the detection accuracy of the pressure sensor for a strike can be improved compared to the case where the weight portion is continuously provided along the shape of the pressure sensor.

According to the electronic percussion instrument of a technical solution, the weight portion or the connection portion is formed of an elastic material having a hardness set in a range of 50 degrees to 90 degrees. Thus, easiness of deformation of the weight portion or the connection portion is adjusted, so as to increase the pressing force toward the pressure sensor caused by the inertial force acting on the weight portion. As a result, an effect is obtained that the detection accuracy of the pressure sensor for a strike can be further improved.

According to a struck position detector of a technical solution, a vibration of the pad is detected by a vibration sensor provided on the central portion of the pad of the electronic percussion instrument. Then, a pressure change caused by a strike on the pad is detected by the pressure sensor provided on the outer circumferential end portion of the pad. Furthermore, whether a first output value being an output value of the vibration sensor is equal to or greater than a predetermined value is determined by a first determination means. Whether a second output value being an output value of the pressure sensor is equal to or greater than a predetermined value is determined by a second determination means. In a certain period, if the second determination means has determined that the second output value is equal to or greater than the predetermined value before the first determination means determines that the first output value is equal to or greater than the predetermined value, a third determination means determines that the outer circumferential end portion is struck. Time required from when a predetermined place is struck until when vibration is transmitted to the vibration sensor differs from time required until when the pressing force for causing the pressure change is applied to the pressure sensor. Due to a time difference therebetween, if it is detected that the pressure sensor outputs the output value equal to or greater than the predetermined value earlier than the vibration sensor, it can be determined that the outer circumferential end portion is struck. As a result, an effect is obtained that detection accuracy for a struck position can be improved by the third determination means.

According to the struck position detector of a technical solution, a time difference between when the first determination means determines that the first output value is equal to or greater than the predetermined value and when the second determination means determines that the second output value is equal to or greater than the predetermined value is calculated. If the time difference is equal to or less than a threshold, the third determination means determines that the outer circumferential end portion is struck. When the outer circumferential end portion is struck, although sometimes the vibration sensor detects the output value equal to or greater than the predetermined value earlier than the pressure sensor, it can be determined by the third determination means that the outer circumferential end portion is struck. Accordingly, an effect is obtained that erroneous detection of the struck position can be suppressed.

DESCRIPTION OF THE EMBODIMENTS

Figure 1:
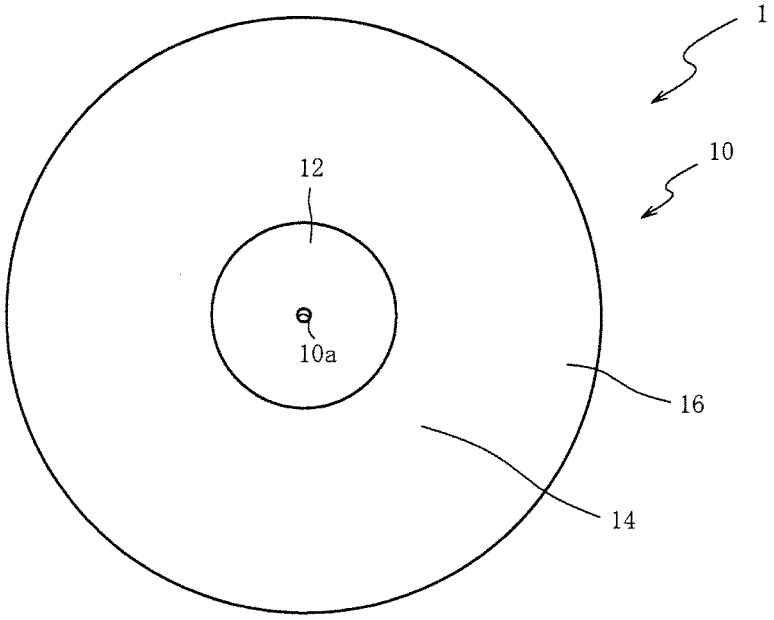
FIG. 1 is a plan view of an electronic percussion instrument according to the first embodiment of the invention.
Figure 2:
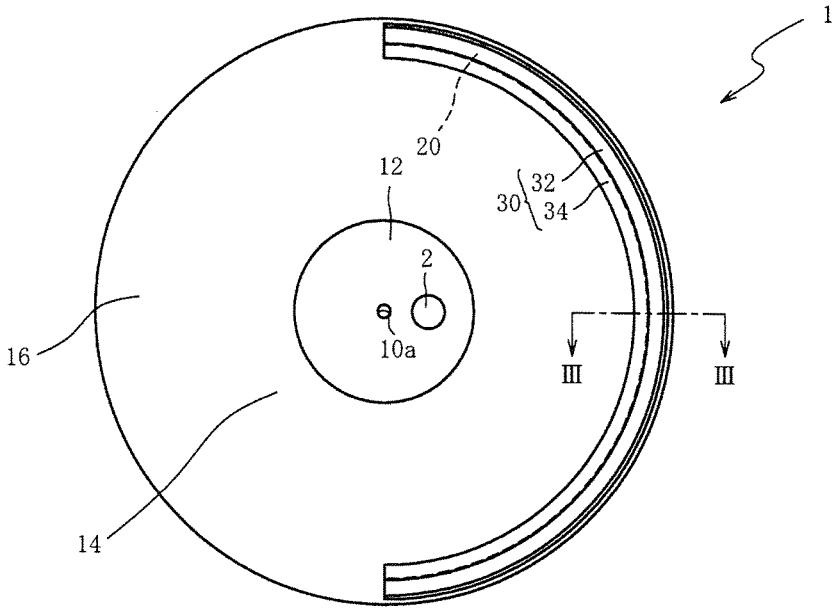
FIG. 2 is a bottom view of the electronic percussion instrument.

Preferred embodiments of the invention are explained hereinafter in detail with reference to the accompanying drawings. First, an electronic percussion instrument 1 according to the first embodiment of the invention is explained with reference to FIG. 1 and FIG. 2. FIG. 1 is a plan view of the electronic percussion instrument 1 according to the first embodiment of the invention; FIG. 2 is a bottom view of the electronic percussion instrument 1. Moreover, the right side of the paper surface of FIG. 2 is defined as the player side.

As shown in FIG. 1 and FIG. 2, the electronic percussion instrument 1 is an electronic percussion instrument simulating an acoustic cymbal. The electronic percussion instrument 1 includes a pad 10, a vibration sensor 2, a pressure sensor 20, and a weight member 30. The pad 10 has a front surface to be struck and is formed in a circular plate shape. The vibration sensor 2 detects a vibration of the pad 10. The pressure sensor 20 detects a pressure change and is formed in a sheet shape. The weight member 30 presses the pressure sensor 20. Moreover, the pad 10 is not limited to the circular plate shape. It is certainly possible to use the pad 10 having a circular sector planar shape or including a plate of a polygonal planar shape or of an elliptical planar shape.

The pad 10 is a member made of bronze, formed by imitating the shape of an acoustic cymbal. The pad 10 is swingably supported by a stand (not illustrated) at a support hole 10*a* provided in the center. The pad 10 includes a bell portion 12 (central portion), a bow portion 14 (central portion), and an edge portion 16 (outer circumferential end portion). The bell portion 12 (central portion) has a central part formed in a bowl shape. The bow portion 14 (central portion) is provided extending in a flange-like manner from an outer edge of the bell portion 12, and is formed in an annular shape. The edge portion 16 (outer circumferential end portion) forms an outer circumferential end part of the bow portion 14. Moreover, in this specification, a range from an outer circumferential end of the pad 10 to at least an end portion of the pressure sensor 20 toward the bell portion 12 is defined as the edge portion 16.

The vibration sensor 2 is a piezo sensor, installed closer to the player than the support hole 10*a* on a back surface of the bell portion 12. The pressure sensor 20 is provided in an arc shape over a half circumference of a back surface of the edge portion 16 on the player side. That is, the pressure sensor 20 extends along the outer circumference of the pad 10. The pressure sensor 20 is installed on the back surface of the edge portion 16. The weight member 30 is continuously provided in a circumferential direction of the edge portion 16 (i.e., the pressure sensor 20) along the shape of the pressure sensor 20 so as to cover a side of the pressure sensor 20 toward the bell portion 12. Since no sensor or the like is installed on the front surface of the pad 10, the appearance of the electronic percussion instrument 1 can be made close to that of the acoustic cymbal.

Figure 3:
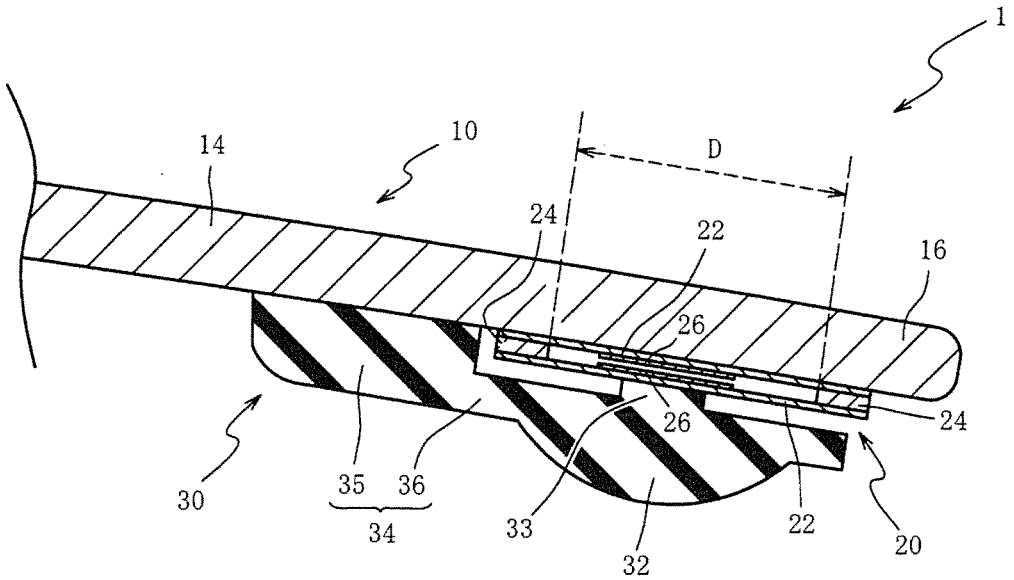
FIG. 3 is a cutaway end view of the electronic percussion instrument taken along line in FIG. 2.

Next, the pressure sensor 20 and the weight member 30 are explained with reference to FIG. 3. FIG. 3 is a cutaway end view of the electronic percussion instrument 1 taken along line III-III in FIG. 2. The pressure sensor 20 is a sensor detecting that a specific playing operation is performed. The specific playing operation refers to an operation of striking the edge portion 16, and a choking technique of holding the edge portion 16 by hand so as to mute a produced musical sound.

As shown in FIG. 3, the pressure sensor 20 is a sheet-like membrane switch that detects a pressure change. A back surface of the pressure sensor 20 is adhered to the back surface of the edge portion 16. The pressure sensor 20 includes a pair of films 22, a spacer 24, and a pair of electrodes 26. The pair of films 22 are formed in an arc shape. The spacer 24 connects the pair of films 22 to each other along a peripheral edge of the pair of films 22. The pair of electrodes 26 are each provided on each of the films 22 along an arc-shaped space surrounded by the films 22 and the spacer 24.

Moreover, when the pad 10 is struck more strongly by the player, the pad 10 is greatly deformed. Thus, when the entire back surface of the pressure sensor 20 is adhered to the back surface of the edge portion 16, there is a risk that the pressure sensor 20 may peel from the edge portion 16, or that the electrode 26 may be disconnected. To suppress stress that occurs in the pressure sensor 20, the pressure sensor 20 is preferably partially adhered to the back surface of the edge portion 16. In addition, the invention is not limited to the case where the pressure sensor 20 is adhered to the edge portion 16. It is also possible that both ends of the pressure sensor 20 are partially fixed to the edge portion 16 by a rivet or the like.

In the pressure sensor 20, since a thickness of the electrode 26 is smaller than half a thickness (dimension in a facing direction of the film 22) of the spacer 24, the pair of electrodes 26 face each other with a predetermined gap therebetween. The pressure sensor 20 falls in a range between the spacer 24 on the side of the bell portion 12 and the spacer 24 on the side of the outer circumferential end of the pad 10. By pressing a front surface of the film 22 in a range (deformable range D) in which the film 22 is deformable, the film 22 on the front surface side is deformed. Due to the deformation, the pair of electrodes 26 contact each other. Thereby, an electrical signal is outputted from the pressure sensor 20, and the pressure sensor 20 detects a pressure change applied to the film 22 (received by the pressure sensor 20 itself).

The weight member 30 is an arc-shaped member made of rubber having a hardness (based on JISK6253-3:2012) set to 70 degrees. The weight member 30 includes a weight portion 32 and a connection portion 34. The weight portion 32 nonadhesively contacts the front surface of the pressure sensor 20 in the deformable range D. The connection portion 34 is adhered and fixed to the pad 10 at a position closer to the bell portion 12 than the pressure sensor 20, and is connected to the weight portion 32. The weight portion 32 and the connection portion 34 are provided over a circumferential direction of the weight member 30. Moreover, the hardness of the rubber that forms the weight member 30 is not limited to 70 degrees, and is preferably not lower than 50 degrees (or higher than 50 degrees) and not higher than 90 degrees (or lower than 90 degrees). The hardness of the rubber that forms the weight member 30 is more preferably not lower than 60 degrees (or higher than 60 degrees) and not higher than 80 degrees (or lower than 80 degrees).

In the weight portion 32, a protrusion portion 33 contacts the pressure sensor 20 in the deformable range D. In the protrusion portion 33, a radial section protrudes toward the pressure sensor 20 in a rectangular shape with a width smaller than the deformable range D. Moreover, the radial section of the protrusion portion 33 is not limited to the rectangular shape, and may be formed into a triangular shape or an arc shape, etc. The weight portion 32 is formed expanding toward an opposite side of the protrusion portion 33 (so as to be away from the pressure sensor 20). By properly setting the amount of this expansion, the mass of the weight portion 32 is set.

The connection portion 34 includes a thick-walled portion 35 and a thin-walled portion 36. The thick-walled portion 35 substantially vertically extends from a back surface of the pad 10. The thin-walled portion 36 extends from the thick-walled portion 35 outward in the radial direction of the weight member 30, and is connected to the weight portion 32. The thin-walled portion 36 is smaller in thickness (dimension in the facing direction of the film 22) than the thick-walled portion 35. Due to the thin-walled portion 36, the connection portion 34 can be easily bent.

Figure 4:
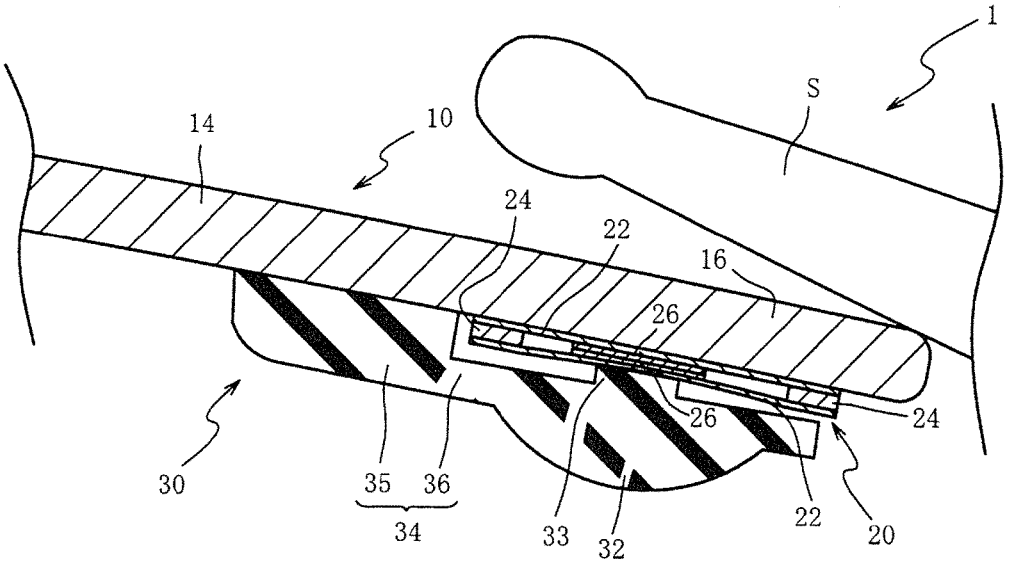
FIG. 4 is a cutaway end view of the electronic percussion instrument, showing a state in which an edge portion of a pad of the electronic percussion instrument is struck.

Next, an action of the pad 10 when struck is explained with reference to FIG. 4. FIG. 4 is a cutaway end view of the electronic percussion instrument 1, showing a state in which the edge portion 16 of the pad 10 of the electronic percussion instrument 1 is struck. As shown in FIG. 4, when the edge portion 16 is struck by a stick S, the pad 10 vibrates, and the vibration sensor 2 (see FIG. 2) detects the vibration. Since the pad 10 (edge portion 16) is made of bronze, a striking feeling can be made close to that of the acoustic cymbal.

Furthermore, when the edge portion 16 is struck, the pad 10 swings about the support hole 10*a*, and the edge portion 16 on the struck side moves toward the weight portion 32 (lower side of the paper surface of FIG. 4). On the other hand, the weight portion 32 is nonadhesive to the pressure sensor 20, and the weight member 30 (connection portion 34) is made of rubber. Thus, the weight member 30 is in a cantilever state in which the connection portion 34 is deformed by bending. The weight portion 32 is a free end of the weight member 30, and is about to stay at its position due to inertia. Accordingly, an inertial force from the front surface of the pressure sensor 20 toward the back surface of the pad 10 acts on the weight portion 32. Thus, the weight portion 32 is able to press the pressure sensor 20 in the deformable range D. Even if the edge portion 16 is weakly struck (when a weak strike occurs on the edge portion 16), a predetermined inertial force acts on the weight portion 32 so that the weight portion 32 presses the pressure sensor 20. Thus, even when a weak strike occurs on the edge portion 16, the pressure sensor 20 is still able to detect a pressure change. Accordingly, detection accuracy of the pressure sensor 20 for a strike can be improved.

If the weight portion 32 is adhered to the pressure sensor 20, deformation of the film 22 is affected by rigidity of the weight portion 32. Thus, there is a risk that the deformation of the film 22 may be hindered to reduce detection sensitivity of the pressure sensor 20. Furthermore, an adhesion layer formed of a cured adhesive is formed between the pressure sensor 20 and the weight portion 32. Thus, there is a risk that the detection sensitivity of the pressure sensor 20 may be reduced due to the adhesion layer. In contrast, in the present embodiment, the pressure sensor 20 and the weight portion 32 are nonadhesive to each other. Thus, reduction in detection sensitivity of the pressure sensor 20 caused by the rigidity of the weight portion 32 or the adhesion layer can be prevented. As a result, the detection accuracy of the pressure sensor 20 for a strike can be further improved compared to the case where the weight portion 32 is adhered to the pressure sensor 20.

If the connection portion 34 of the weight member 30 in the cantilever state is less likely to be bent, the pad 10 and the connection portion 34 easily integrally move, and the pad 10 and the pressure sensor 20 easily move simultaneously with the weight portion 32. In this case, a pressing force toward the pressure sensor 20 caused by the inertial force acting on the weight portion 32 is reduced. In contrast, in the present embodiment, the connection portion 34 can be easily bent due to the thin-walled portion 36. As a result, it can be suppressed that the connection portion 34 reduces the pressing force toward the pressure sensor 20 caused by the inertial force acting on the weight portion 32. As a result, the detection accuracy of the pressure sensor 20 for a strike can be further improved.

In addition, if the hardness of the rubber that forms the weight member 30 is higher than 90 degrees, the connection portion 34 is less likely to be bent, and the pressing force toward the pressure sensor 20 caused by the inertial force acting on the weight portion 32 is reduced. Thus, the detection sensitivity of the pressure sensor 20 for a strike deteriorates. On the other hand, by setting the hardness of the rubber that forms the weight member 30 to not higher than 90 degrees (70 degrees in the present embodiment), the connection portion 34 can be easily bent. Due to this, the pressing force toward the pressure sensor 20 caused by the inertial force acting on the weight portion 32 can be increased. Accordingly, the detection sensitivity of the pressure sensor 20 for a strike is improved, so as to further improve the detection accuracy of the pressure sensor 20. Moreover, the lower the hardness of the rubber that forms the weight member 30, the more easily the connection portion 34 can be bent. Thus, the detection accuracy of the pressure sensor 20 for a strike, which depends on bending easiness of the connection portion 34, can be improved.

If the hardness of the rubber that forms the weight member 30 is lower than 50 degrees, the weight portion 32 (protrusion portion 33) is easily deformed. That is, there is a risk that, when the weight portion 32 presses the pressure sensor 20, the weight portion 32 (protrusion portion 33) may be relatively greatly crushed in the direction of the inertial force that acts on the weight portion 32. In this case, time for settling a vibration caused by contraction or expansion of the weight portion 32 after a strike is increased, so that the pressure sensor 20 performs erroneous detection, and there is a risk that the detection accuracy of the pressure sensor 20 for a strike may deteriorate. On the other hand, by setting the hardness of the rubber that faints the weight member 30 to not lower than 50 degrees, crushing of the weight portion 32 (protrusion portion 33) is suppressed, so as to shorten the time until the vibration of the weight portion 32 is settled. Thus, the detection accuracy of the pressure sensor 20 for a strike can be further improved. Moreover, the higher the hardness of the rubber that forms the weight member 30, the more possible it is to suppress the crushing of the weight portion 32. Thus, the detection accuracy of the pressure sensor 20 for a strike, which depends on vibration of the weight portion 32, can be improved.

When a predetermined position on the edge portion 16 of the circular pad 10 that swings about the support hole 10*a* is struck, a part of the edge portion 16 located on a straight line passing through the support hole 10*a* and the struck position most greatly swings. Due to this, the maximum inertial force acts on a part of the weight portion 32 located on the back surface of the edge portion 16. Since the weight portion 32 is made of rubber, a part of the weight portion 32 in the circumferential direction can be elastically deformed. Thus, the part of the weight portion 32 on which the maximum inertial force acts is elastically deformed, so as to press the pressure sensor 20. As a result, the detection accuracy of the pressure sensor 20 for a strike can be further improved. Furthermore, the lower the hardness of the rubber that forms the weight portion 32, the more easily the part of the weight portion 32 in the circumferential direction can be elastically deformed. Thus, by setting the hardness of the rubber that forms the weight member 30 to not higher than 90 degrees, the detection accuracy of the pressure sensor 20 for a strike can be further improved.

Since the protrusion portion 33 that presses the pressure sensor 20 in the deformable range D has a width smaller than the deformable range D, it can be prevented that the spacer 24 hinders the deformation of the film 22 caused by the pressing by the protrusion portion 33. As a result, the pressure sensor 20 can be reliably pressed by the protrusion portion 33 in the deformable range D, and thus the detection accuracy of the pressure sensor 20 for a strike can be further improved.

When the bell portion 12 or the bow portion 14 is struck by the stick S, the pad 10 vibrates, and the vibration sensor 2 detects the vibration. Furthermore, in the case where the bell portion 12 or the bow portion 14 is struck, if the strength of striking is the same, swinging of the edge portion 16 is smaller than in the case where the edge portion 16 is struck. Thus, the inertial force acting on the weight portion 32 can be reduced. Hence, the pressing force toward the pressure sensor 20 caused by the inertial force acting on the weight portion 32 can be reduced, and the pressure sensor 20 can be made less likely to detect a pressure change. Thus, it can be suppressed that the pressure sensor 20 performs erroneous detection in the case where the bell portion 12 or the bow portion 14 is struck. Moreover, even in the case where the bell portion 12 or the bow portion 14 is struck, sometimes the pressure sensor 20 detects a pressure change, depending on the strength of striking.

As described above, when the pad 10 is struck, due to the pressing force toward the pressure sensor 20 caused by the inertial force acting on the weight portion 32, the pressure sensor 20 detects a pressure change. Thus, the greater the mass of the weight portion 32, the more the detection sensitivity of the pressure sensor 20 for a strike can be improved. However, when the mass of the weight portion 32 is set great, not only in the case where the edge portion 16 is struck but also in the case where the bell portion 12 or the bow portion 14 is struck, the detection sensitivity of the pressure sensor 20 for a strike is improved. Hence, the mass of the weight portion 32 is set by taking into consideration a balance between the detection sensitivity of the pressure sensor 20 in the case where the edge portion 16 is struck and the detection sensitivity of the pressure sensor 20 in the case where the bell portion 12 or the bow portion 14 is struck. Accordingly, the detection accuracy of the pressure sensor 20 for a strike can be improved.

In addition, during playing of the electronic percussion instrument 1, a choking technique is performed in which the edge portion 16 of the pad 10 that vibrates due to striking is held by hand. In the choking technique, based on the pressure change detected by the pressure sensor 20 when the edge portion 16 is held by hand, a produced musical sound is muted. Since the weight portion 32 is provided on the front surface of the pressure sensor 20 in the deformable range D, when the player holds the edge portion 16 to perform the choking technique, the player's hand touches the weight portion 32. Hence, the pressure sensor 20 can be reliably pressed through the weight portion 32. Furthermore, since the weight portion 32 is formed expanding so as to be away from the pressure sensor 20, the weight portion 32 can be easily recognized, and is able to more reliably press the pressure sensor 20.

Herein, time required from when a predetermined place on the pad 10 is struck until when vibration is transmitted to the vibration sensor 2 is hereinafter referred to as "vibration transmission time". Furthermore, time required until when the pressing force for causing a pressure change in the pressure sensor 20 is applied to the pressure sensor 20 is hereinafter referred to as "pressure transmission time". The vibration transmission time and the pressure transmission time are different from each other. The vibration transmission time is determined by a vibration transmission speed of a material that forms the pad 10 (bow portion 14 and edge portion 16) as well as a distance from a struck position to the vibration sensor 2. Moreover, the vibration transmission speed of the material that forms the pad 10 does not depend on the strength of striking. On the other hand, the pressure transmission time depends on speed at which the pad 10 tilts (in response to strength of striking), the inertial force acting on the weight portion 32, or magnitude of force that hinders deformation or movement of the weight portion 32 (weight member 30). Due to a time difference between the vibration transmission time and the pressure transmission time, if the edge portion 16 is struck, sometimes the vibration sensor 2 detects a vibration earlier than when the pressure sensor 20, which is close to the struck position, detects a pressure change.

Figure 5:
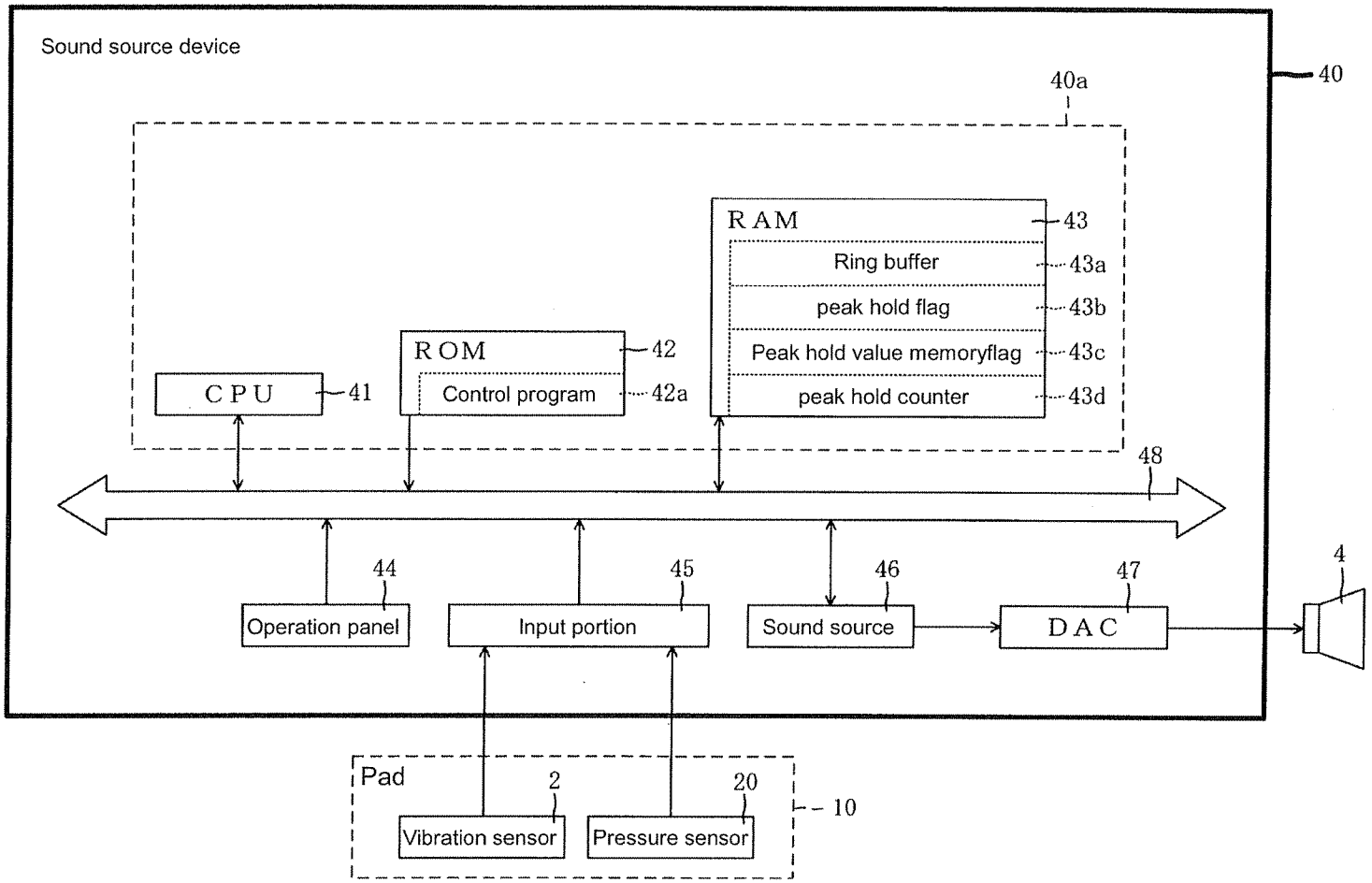
FIG. 5 is a block diagram showing an electric configuration of a sound source device.

For that reason, the electronic percussion instrument 1 includes a sound source device 40 for detecting a struck position by a struck position detector 40*a* based on output values of the vibration sensor 2 and the pressure sensor 20 so as to produce a musical sound. A detailed configuration of the sound source device 40 that is applicable to the electronic percussion instrument 1 is explained with reference to FIG. 5. FIG. 5 is a block diagram showing an electric configuration of the sound source device 40.

The sound source device 40 includes a CPU 41, an ROM 42, an RAM 43, an operation panel 44, an input portion 45, a sound source 46, and a digital-to-analog converter (DAC) 47. Furthermore, the elements 41 to 47 are connected to one another through a bus line 48. Moreover, the struck position detector 40*a* includes the CPU 41, the ROM 42, and the RAM 43. The input portion 45 is connected to the vibration sensor 2 and the pressure sensor 20 that are installed on the pad 10.

The CPU 41 is a central control unit that controls each element of the sound source device 40 in accordance with fixed values or programs stored in the ROM 42, data stored in the RAM 43 and so on. The CPU 41 has built therein a timer (not illustrated) for counting a time by counting a clock signal.

Figure 9:
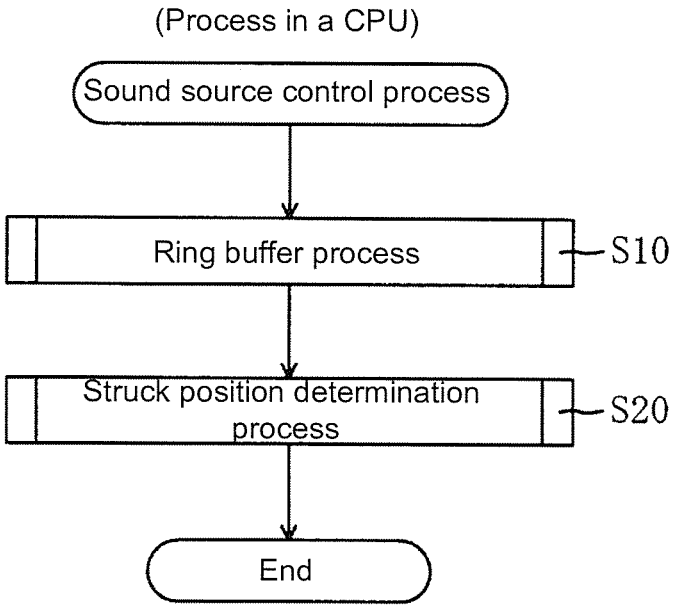
FIG. 9 is a flowchart showing a sound source control process.
Figure 10:
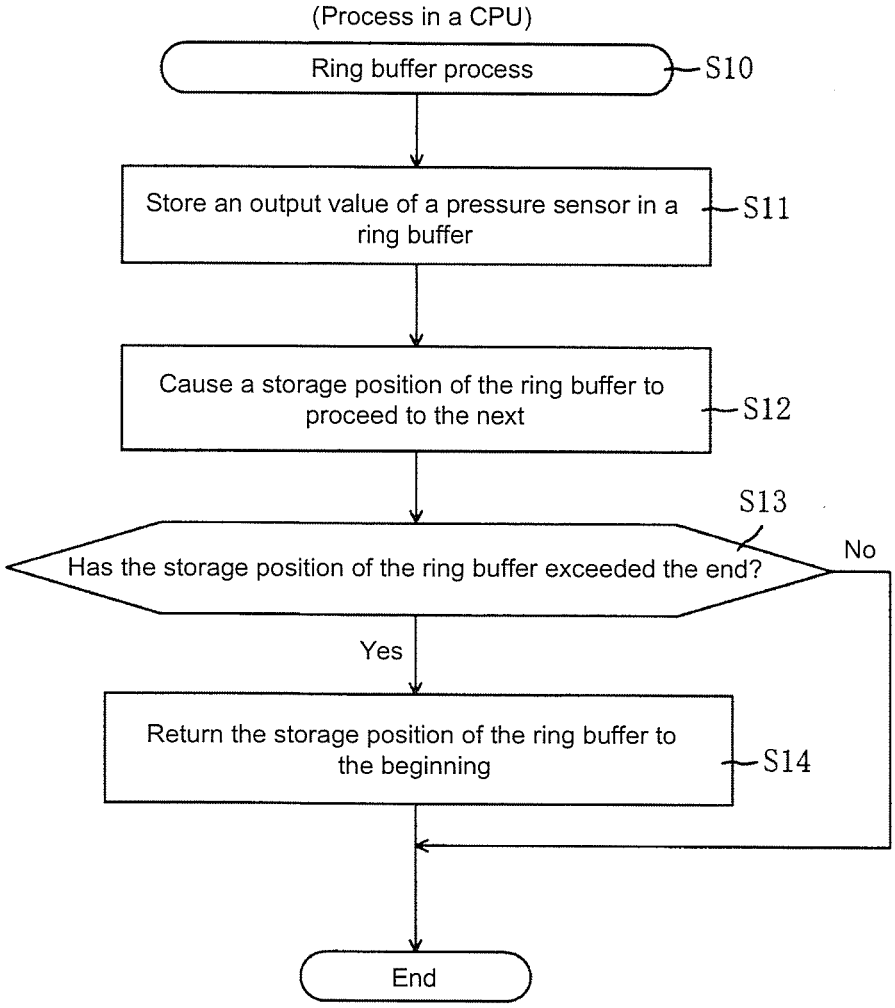
FIG. 10 is a flowchart showing a ring buffer process.
Figure 11:
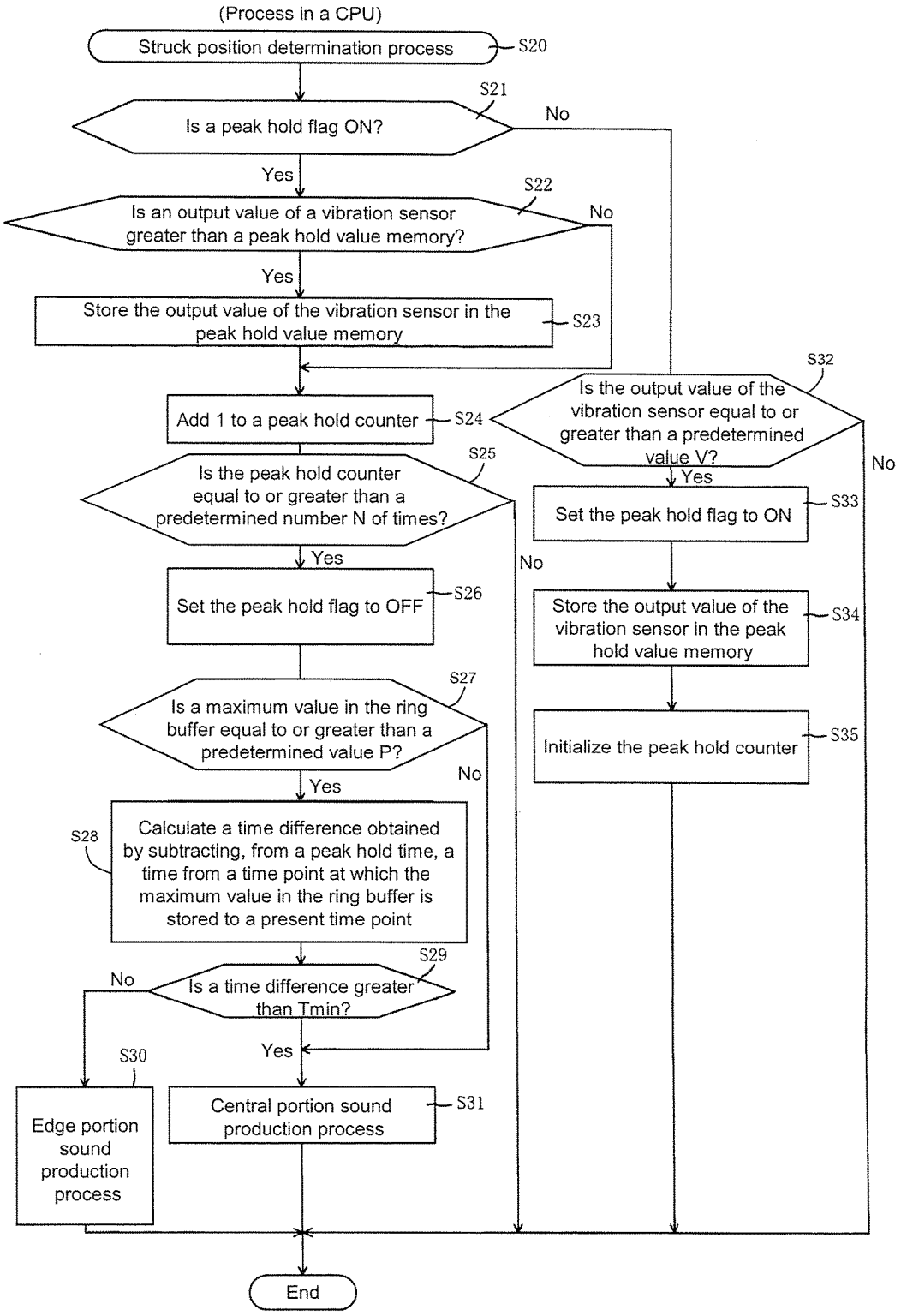
FIG. 11 is a flowchart showing a struck position determination process.

The ROM 42 is an unrewritable non-volatile memory. The ROM 42 stores a control program 42*a* or fixed value data (not illustrated) and so on. The control program 42*a* is executed by the CPU 41 or the sound source 46. The fixed value data (not illustrated) is referred to by the CPU 41 when the control program 42*a* is executed. Moreover, the processes shown in the flowcharts in FIGS. 9 to 11 are executed based on the control program 42*a*.

The RAM 43 is a rewritable volatile memory. The RAM 43 has a temporary area for temporarily storing various data when the CPU 41 executes the control program 42*a*. In the temporary area of the RAM 43, a ring buffer 43*a*, a peak hold flag 43*b*, a peak hold value memory 43*c*, and a peak hold counter 43*d* are provided. Each of the above elements 43*a* to 43*d* provided in the RAM 43 is initialized when power is supplied to the sound source device 40.

The ring buffer 43*a* is a buffer storing an output value of the pressure sensor 20 in a time series. Writing to the ring buffer 43*a* is performed successively from the beginning of a storage position of the ring buffer 43*a*. When the writing reaches the end of the storage position of the ring buffer 43*a*, the process returns to the beginning of the storage position of the ring buffer 43*a*, and the writing is continued from the beginning of the storage position. Moreover, the ring buffer 43*a* is configured to hold 9 pieces of data in the present embodiment. Since an execution period of a ring buffer process (sound source control process) is 400 μsec, the output value of the pressure sensor 20 is held in the ring buffer 43*a* over 3.2 msec.

The peak hold flag 43*b* is a flag indicating whether or not a peak hold time Tp (see FIGS. 6 to 8) is being counted by the peak hold counter 43*d*. An initial state of the peak hold flag 43*b* is set to OFF. Specifically, if the peak hold flag 43*b* is set to ON, it indicates that the peak hold time Tp is being counted. The peak hold flag 43*b* is set to ON when time counting performed by the peak hold counter 43*d* is started, and is set to OFF when the time counting ends. Moreover, in the present embodiment, the peak hold time Tp is set to 2 msec.

The peak hold value memory 43*c* is a memory holding a peak level of an output value of the vibration sensor 2 inputted from the vibration sensor 2 through the input portion 45. When input of the output value of the vibration sensor 2 through the input portion 45 is started, a peak hold is executed for the predetermined peak hold time Tp. During the peak hold, every time a maximum value of an output value of the vibration sensor 2 sampled by the CPU 41 is updated, the value is stored in the peak hold value memory 43*c*. A value of the peak hold value memory 43*c* when the peak hold time Tp ends is taken as the peak level (maximum value) of the output value of the vibration sensor 2.

The peak hold counter 43*d* is a counter counting the peak hold time Tp for obtaining the peak level of the output value of the vibration sensor 2. An initial value of the peak hold counter 43*d* is set to 0. The peak hold counter 43*d* is initialized if the output value of the vibration sensor 2 exceeds a predetermined value V after the input of the output value of the vibration sensor 2 is started, and is incremented by 1 at intervals of the execution period of the sound source control process. That is, a number of times the sound source control process has been performed since the start of the time counting of the peak hold time Tp is counted. Moreover, the predetermined value V is a threshold set with respect to the output value of the vibration sensor 2, and is a threshold for determining whether or not the output value of the vibration sensor 2 is based on noise. After the time counting is started, when the preset peak hold time Tp passes, the time counting is stopped.

The operation panel 44 is a panel on which an operator and an indicator are provided. The operator is used for setting various parameters such as volume and so on. The indicator displays values of the parameters set by the operator and so on. The operation panel 44 is used as a user interface. The input portion 45 is an interface that connects the vibration sensor 2 and the pressure sensor 20 that are installed on the pad 10. An analog signal waveform outputted from the vibration sensor 2 is inputted to the sound source device 40 through the input portion 45. The input portion 45 has built therein a digital-to-analog converter (not illustrated). The analog signal waveform outputted from the vibration sensor 2 and the pressure sensor 20 is converted to a digital value by the DAC at predetermined time intervals. The CPU 41 determines a struck position on the pad 10 based on the digital value converted in the input portion 45.

If the sound source 46 receives from the CPU 41 a sound production command for producing a musical sound, the sound source 46 produces a musical sound having timbre and volume in accordance with the sound production command. The sound source 46 has built therein a waveform ROM (not illustrated). The waveform ROM stores a digital musical sound having timbre corresponding to the pad 10. In addition, the sound source 46 has built therein a digital signal processor (DSP) (not illustrated). The DSP performs a filtering process or an effect process, etc. If the sound production command is inputted to the sound source 46 from the CPU 41, the sound source 46 reads from the waveform ROM a digital musical sound having the timbre in accordance with the sound production command. Next, the sound source 46 performs a predetermined process such as the filtering process or the effect process and so on in the DSP with respect to the read digital musical sound. Furthermore, the sound source 46 outputs a processed digital musical sound to the DAC 47. The DAC 47 converts the inputted digital musical sound into an analog musical sound, and outputs it to a speaker 4 provided outside the sound source device 40. Accordingly, a musical sound based on the striking on the pad 10 is emitted from the speaker 4.

Figure 6:
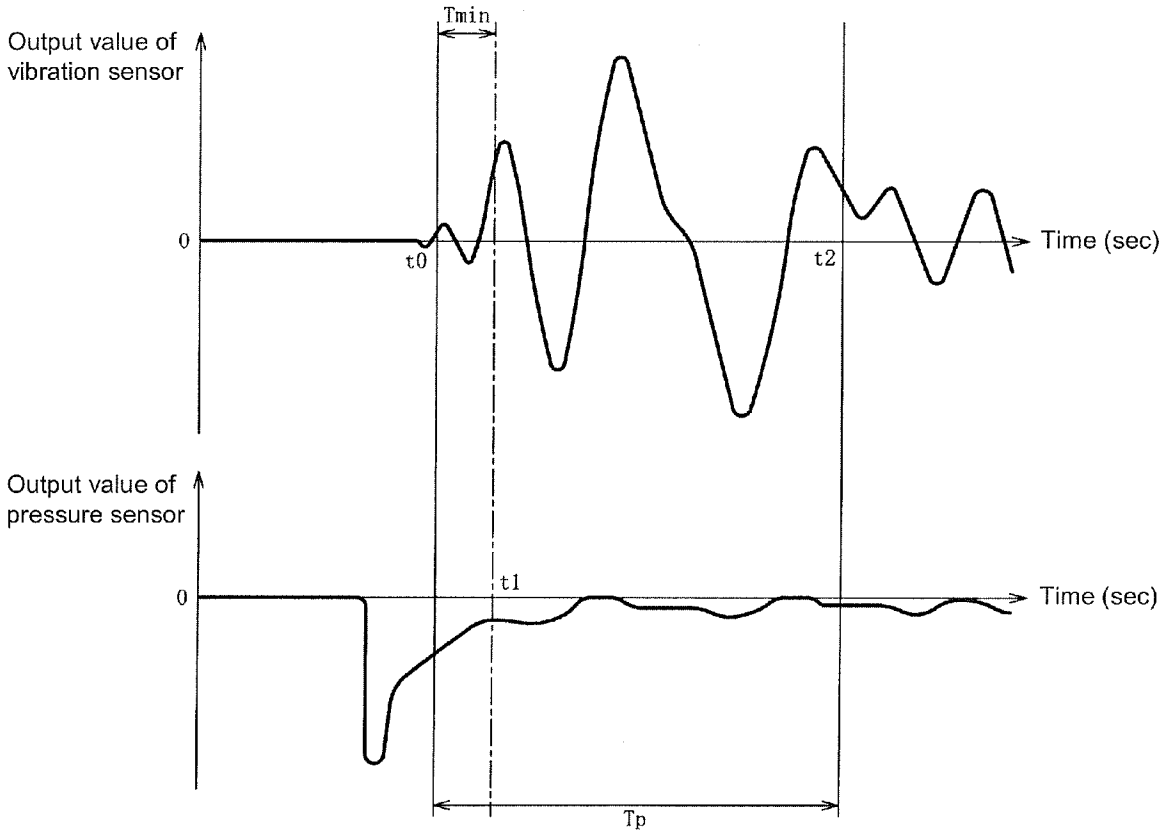
FIG. 6 is a graph of output values of a vibration sensor and a pressure sensor with respect to time when the edge portion is strongly struck.
Figure 7:
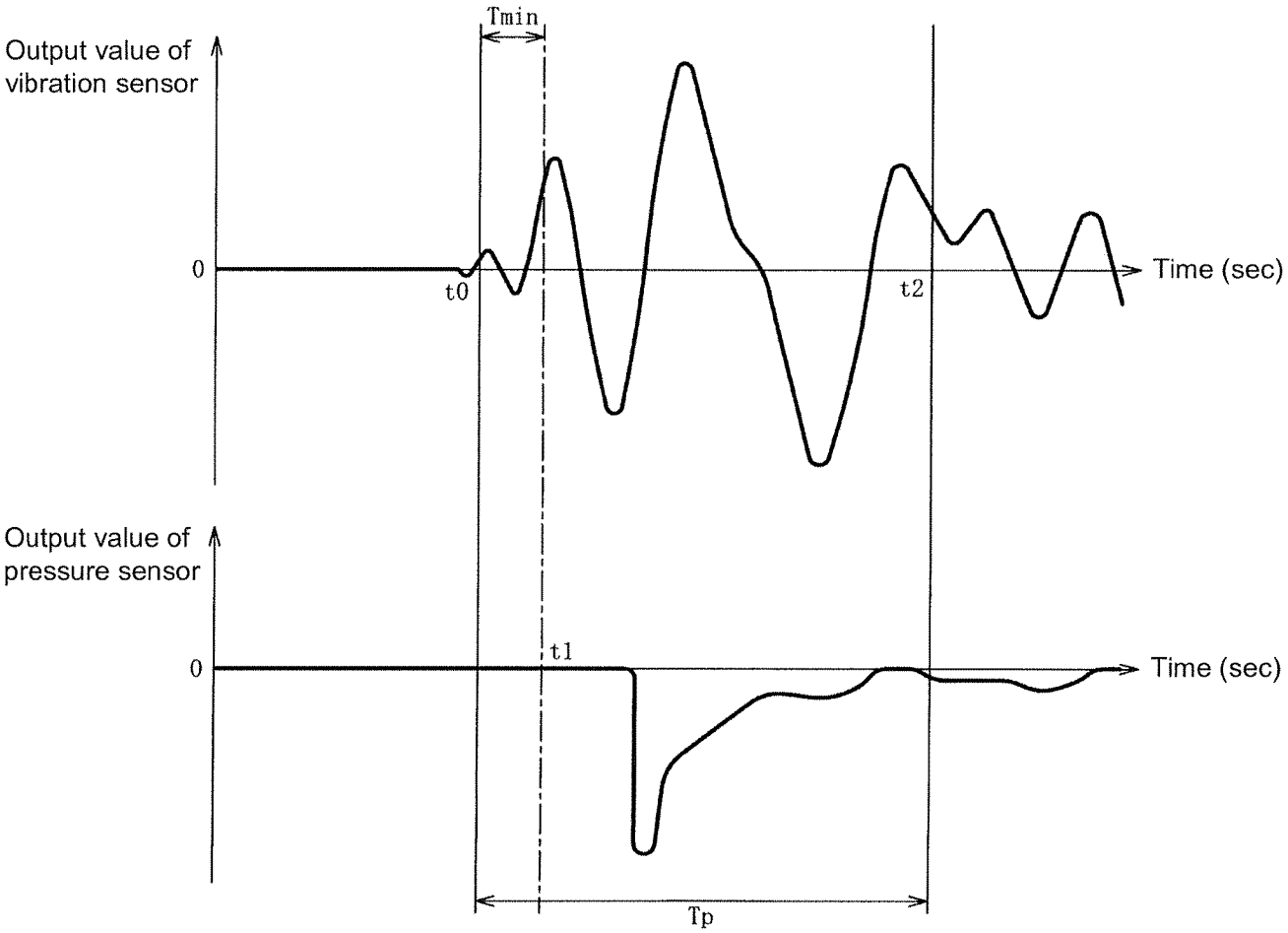
FIG. 7 is a graph of the output values of the vibration sensor and the pressure sensor with respect to time when a bell portion or a bow portion is strongly struck.
Figure 8:
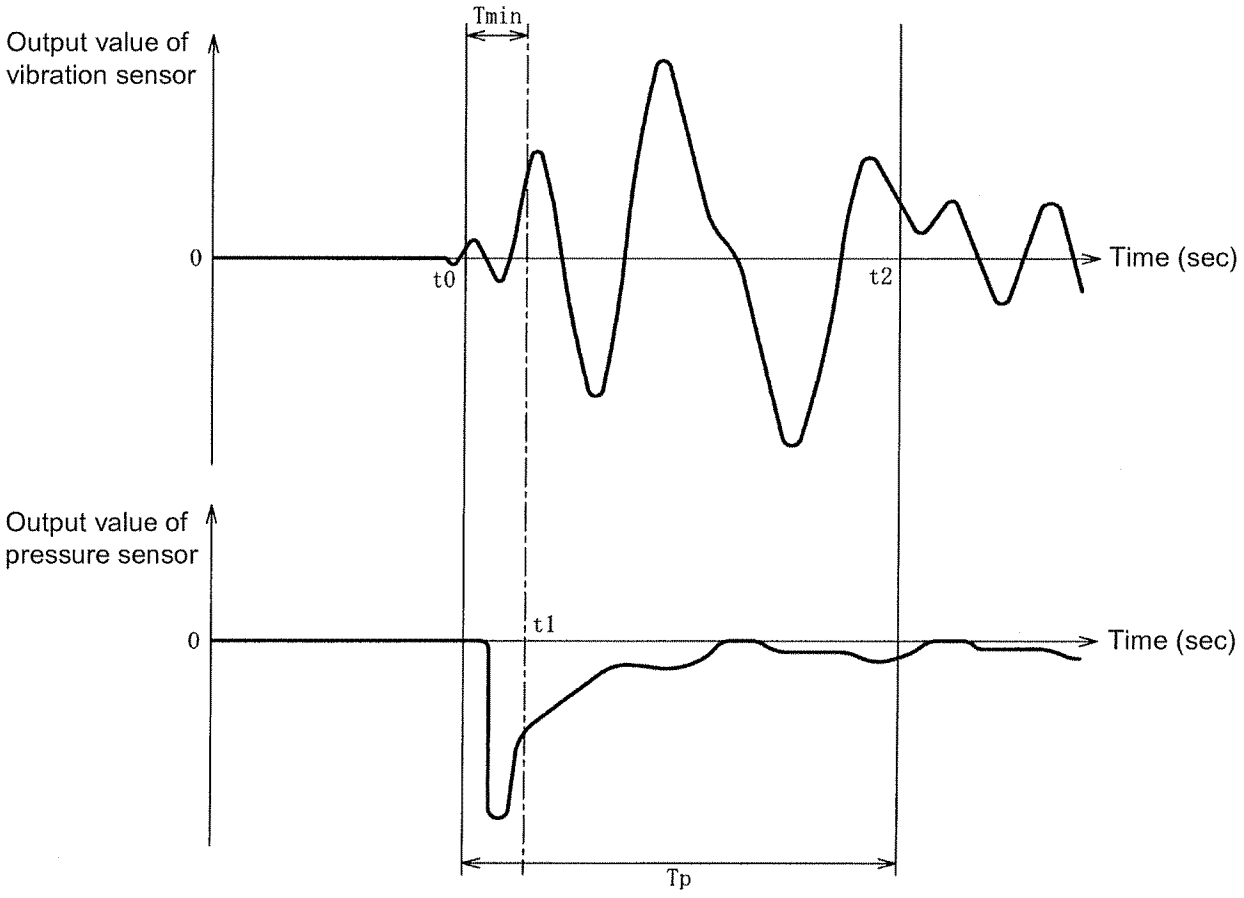
FIG. 8 is a graph of the output values of the vibration sensor and the pressure sensor with respect to time when the edge portion is weakly struck.

Next, a relationship between an output waveform from the vibration sensor 2 and an output waveform from the pressure sensor 20 depending on the struck position and the strength of striking is explained with reference to FIG. 6, FIG. 7 and FIG. 8. FIG. 6 is a graph showing the output waveforms of the vibration sensor 2 and the pressure sensor 20 when the edge portion 16 is strongly (relatively strongly) struck. FIG. 7 is a graph showing the output waveforms of the vibration sensor 2 and the pressure sensor 20 when the bell portion 12 or the bow portion 14 (central portion) is strongly struck. FIG. 8 is a graph showing the output waveforms of the vibration sensor 2 and the pressure sensor 20 when the edge portion 16 is weakly (relatively weakly) struck.

In the waveform graphs shown in FIGS. 6 to 8, the vertical axis indicates the output value of each of the vibration sensor 2 and the pressure sensor 20, and the horizontal axis indicates time. The horizontal axis is on the same scale in all the graphs in FIGS. 6 to 8. However, the vertical axis is on a smaller scale in the graph in FIG. 8 than in the graphs in FIGS. 6 and 7. Furthermore, the graph of the output value of the pressure sensor 20 in FIG. 7 is on a smaller scale than in FIG. 6. In addition, the output value of the vibration sensor 2 and the output value of the pressure sensor 20 indicated by the vertical axis are on different scales. In FIGS. 6 to 8, a time when the output value of the vibration sensor 2 exceeds the predetermined value V (when the vibration sensor 2 reacts to a strike) is time to. Furthermore, in FIGS. 6 to 8, a time when the peak hold time Tp (2 msec in the present embodiment) has passed from time t0 is t2.

As shown in FIG. 6, when a strong strike occurs on the edge portion 16, due to the relationship between the pressure transmission time and the vibration transmission time, the output value of the pressure sensor 20 rises (the pressure sensor 20 reacts to the strike) before t0. As shown in FIG. 7, when a strong strike occurs on the bell portion 12 or the bow portion 14, due to the relationship between the pressure transmission time and the vibration transmission time, the output value of the pressure sensor 20 rises after t0.

As shown in FIG. 8, when a weak strike occurs on the edge portion 16, due to the relationship between the pressure transmission time and the vibration transmission time, the output value of the pressure sensor 20 rises after t0. In addition, although not illustrated, when a weak strike occurs on the bell portion 12 or the bow portion 14, the pressure sensor 20 does not react to the strike, and only the vibration sensor 2 reacts to the strike.

Conventionally, when the bell portion 12 or the bow portion 14 is struck, the pressure sensor 20 does not react to the strike, and only the vibration sensor 2 reacts to the strike. On the other hand, when the edge portion 16 is struck, both the vibration sensor 2 and the pressure sensor 20 react to the strike. Furthermore, when the edge portion 16 is struck, the pressure sensor 20 provided on the edge portion 16 reacts to the strike earlier (before time t0) than the vibration sensor 2. Hence, in a conventional sound source device, when the vibration sensor 2 reacts to the strike and the pressure sensor 20 reacts to the strike, it is determined that the edge portion 16 is struck. Furthermore, in the conventional sound source device, when the vibration sensor 2 reacts to the strike and the pressure sensor 20 does not react to the strike, it is determined that the bell portion 12 or the bow portion 14 is struck.

On the other hand, in the present embodiment, according to the graph in FIG. 7, if the bell portion 12 or the bow portion 14 is strongly struck, not only the vibration sensor 2 but also the pressure sensor 20 react to the strike. In addition, according to the graph in FIG. 8, if the edge portion 16 is weakly struck, the pressure sensor 20 reacts to the strike after time t0. Hence, in the conventional sound source device, even in the case where the edge portion 16 is struck, it is sometimes determined that the bell portion 12 or the bow portion 14 is struck.

Accordingly, in the sound source device 40 in the present embodiment, it is necessary to determine whether a strike that occurs when the pressure sensor 20 reacts after time t0 is caused by striking the bell portion 12 or the bow portion 14 or by striking the edge portion 16. For this purpose, Tmin is set based on the pressure transmission time and the vibration transmission time. In the sound source device 40, if the pressure sensor 20 reacts to a strike earlier than the vibration sensor 2, and, if the pressure sensor 20 reacts to a strike before time t1 after Tmin has passed from time t0, it is determined that the edge portion 16 is struck. On the other hand, if the pressure sensor 20 reacts to a strike after time t1, it is determined that the bell portion 12 or the bow portion 14 is struck.

Next, the processes executed by the CPU 41 of the sound source device 40 (struck position detector 40*a*) having the above configuration are explained with reference to FIG. 9, FIG. 10 and FIG. 11. FIG. 9 is a flowchart showing a sound source control process. FIG. 10 is a flowchart showing a ring buffer process. FIG. 11 is a flowchart showing a struck position determination process.

The sound source control process is periodically (every 400 μsec in the present embodiment) executed by a timer (not illustrated) built in the CPU 41 during while power is being supplied to the sound source device 40. As shown in FIG. 9, with respect to the sound source control process, the CPU 41 performs the ring buffer process (S10), then performs the struck position determination process (S20), and then ends the present process.

As shown in FIG. 10, with respect to the ring buffer process (S10), the CPU 41 stores the output value of the pressure sensor 20 at that time in the current storage position of the ring buffer 43*a* (S11). Next, the CPU 41 causes the storage position of the ring buffer 43*a* to proceed to the next (S12) in preparation for storage of the output value of the pressure sensor 20 in the ring buffer process (S10) executed next time. Furthermore, whether or not the storage position of the ring buffer 43*a* that was caused to proceed in S12 has exceeded the end is determined (S13).

In S13, if the CPU 41 determines that the storage position of the ring buffer 43*a* has exceeded the end (S13: Yes), the CPU 41 returns the storage position of the ring buffer 43*a* to the beginning (S14), and ends the present process. On the other hand, if the CPU 41 determines that the storage position of the ring buffer 43*a* has not exceeded the end (S13: No), the CPU 41 skips the process of S14 and ends the present process.

As shown in FIG. 11, with respect to the struck position determination process (S20), the CPU 41 determines whether or not the peak hold flag 43*b* is ON (S21). In S21, if the CPU 41 determines that the peak hold flag 43*b* is OFF (S21: No), the peak hold time Tp is not being counted. Accordingly, the CPU 41 determines whether or not the output value of the vibration sensor 2 is equal to or greater than the predetermined value V (threshold for determining whether or not the output value of the vibration sensor 2 is based on noise) (S32).

In S32, when the CPU 41 determines that the output value of the vibration sensor 2 is less than the predetermined value V (S32: No), the CPU 41 considers that the output value of the vibration sensor 2 is based on noise, and ends the present process. On the other hand, in S32, when the CPU 41 determines that the output value of the vibration sensor 2 is equal to or greater than the predetermined value V (S32: Yes), the CPU 41 considers that the output value of the vibration sensor 2 is based on striking. Next, the CPU 41 sets the peak hold flag 43*b* to ON (S33), and stores the output value of the vibration sensor 2 in the peak hold value memory 43*c* (S34). Next, the CPU 41 initializes the peak hold counter 43*d* in order to start counting the peak hold time Tp (S35), and ends the present process. Specifically, in S35, the CPU 41 sets the peak hold counter 43*d* to 0.

On the other hand, in S21, if the CPU 41 determines that the peak hold flag 43*b* is ON (S21: Yes), the peak hold time Tp is being counted. Accordingly, the CPU 41 determines whether or not the output value of the vibration sensor 2 at that time is greater than the peak hold value memory 43*c* (output value of the vibration sensor 2 stored in the peak hold value memory 43*c*) (S22).

In S22, if the output value of the vibration sensor 2 is greater than the peak hold value memory 43*c* (S22: Yes), the CPU 41 overwrites and stores the output value of the vibration sensor 2 in the peak hold value memory 43*c* (S23). After that, the CPU 41 moves the process to S24. On the other hand, in S22, if the output value of the vibration sensor 2 is equal to or less than the peak hold value memory 43*c* (S22: No), the CPU 41 skips the process of S23 and moves the process to S24.

In S24, the CPU 41 adds 1 to the peak hold counter 43*d* in order to cause the peak hold counter 43*d* to proceed (S24). Next, the CPU 41 determines whether or not the peak hold counter 43*d* is equal to or greater than a predetermined number N of times (S25). The predetermined number N of times used in S25 in the present embodiment is set to 5 times.

In S25, if the peak hold counter 43*d* is less than the predetermined number N of times (S25: No), the CPU 41 ends the present process. On the other hand, in S25, if the peak hold counter 43*d* is equal to or greater than the predetermined number N of times (S25: Yes), it is considered that the peak hold time Tp has passed. Accordingly, the CPU 41 sets the peak hold flag 43*b* to OFF (S26), and moves the process to S27. In the present embodiment, when it is determined that the output value of the vibration sensor 2 is equal to or greater than the predetermined value V (the output value of the vibration sensor 2 is based on striking), the peak hold counter 43*d* is set to 0. After that, if the peak hold counter 43*d* added every time the sound source control process is executed every 400 μsec has reached 5, the peak hold flag 43*b* is set to OFF. That is, when 2 msec have passed since when it is determined that the output value of the vibration sensor 2 is based on striking, the CPU 41 considers that the peak hold time Tp has passed, and sets the peak hold flag 43*b* to OFF.

In S27, the CPU 41 determines whether or not the maximum value (among the output values of the pressure sensor 20 stored in the ring buffer 43*a*) in the ring buffer 43*a* is equal to or greater than a predetermined value P (S27). Moreover, the predetermined value P is a threshold for determining whether or not the maximum value in the ring buffer 43*a* is based on noise. That is, the predetermined value P is a threshold for determining whether or not all of the output values of the pressure sensor 20 within a predetermined period (3.2 msec in the present embodiment) are based on noise.

In S27, when the CPU 41 determines that the maximum value in the ring buffer 43*a* is less than the predetermined value P (S27: No), the CPU 41 considers that the maximum value in the ring buffer 43*a* is based on noise. Accordingly, the CPU 41 determines that the bell portion 12 or the bow portion 14 (central portion) is struck and executes a central portion sound production process (S31), and ends the present process. Specifically, in S31, the CPU 41 outputs a sound production command to the sound source 46, and outputs various parameters. Herein, the various parameters include a timbre control parameter for the sound source 46 to produce a sound in the case where the bell portion 12 or the bow portion 14 is struck. Furthermore, the various parameters include a volume control parameter based on the output value of the vibration sensor 2 stored in the peak hold value memory 43*c*.

On the other hand, in S27, when the CPU 41 determines that the maximum value in the ring buffer 43*a* is equal to or greater than the predetermined value P (S27: Yes), the CPU 41 considers that the maximum value in the ring buffer 43*a* is based on striking. Accordingly, the CPU 41 calculates a time difference obtained by subtracting, from the peak hold time Tp (2 msec in the present embodiment), a time from a time point at which the maximum value in the ring buffer 43*a* is stored to a present time point (S28). Herein, the present time point refers to a time point at which the output value of the pressure sensor 20 is stored in the ring buffer 43*a* in the present process. In S28, the time from the time point at which the maximum value in the ring buffer 43*a* is stored to the present time point refers to a time calculated by CPU 41 by multiplying, by an execution period, a number obtained by retracing storage positions from a storage position A to a storage position B. Herein, the storage position A refers to a storage position in which the output value of the pressure sensor 20 is stored in the ring buffer 43*a* in the present process. The storage position B refers to a storage position in which the maximum value in the ring buffer 43*a* is stored. This time has a minimum value of 0 msec and a maximum value of 3.2 msec.

Moreover, the time difference calculated in S28 is a time difference between when the time counting of the peak hold time Tp is started and when the maximum value in the ring buffer 43*a* is stored. That is, the time difference indicates a time difference between when the vibration sensor 2 reacts to a strike and when the pressure sensor 20 reacts to the strike. Herein, "when the vibration sensor 2 reacts to a strike" refers to when the vibration sensor 2 outputs the output value that the CPU 41 determines to be equal to or greater than the predetermined value V in S32. On the other hand, "when the pressure sensor 20 reacts to the strike" refers to when the pressure sensor 20 outputs the maximum value in the ring buffer 43*a* that the CPU 41 determines to be equal to or greater than the predetermined value P in S27. Furthermore, the time difference calculated in S28 is a negative value if the pressure sensor 20 reacts to the strike earlier than the vibration sensor 2, and is a positive value if the vibration sensor 2 reacts to the strike earlier than the pressure sensor 20.

Next, the CPU 41 determines whether or not the time difference calculated in S28 is greater than Tmin (S29). Moreover, Tmin is a threshold determined based on the vibration transmission time and the pressure transmission time. In the present embodiment, when the edge portion 16 is struck, sometimes the vibration sensor 2 reacts earlier than the pressure sensor 20. Hence, Tmin is a threshold for determining that the edge portion 16 is struck even if the vibration sensor 2 reacts earlier, and is set to a positive value in the present embodiment.

In S29, when the CPU 41 determines that the time difference calculated in S28 is greater than Tmin (S29: Yes), the CPU 41 determines that the bell portion 12 or the bow portion 14 is struck. Accordingly, the CPU 41 executes the central portion sound production process (S31), and ends the present process. On the other hand, in S29, when the CPU 41 determines that the time difference calculated in S28 is equal to or less than Tmin (S29: No), the CPU 41 determines that the edge portion 16 is struck. Accordingly, the CPU 41 executes an edge portion sound production process (S30), and ends the present process. Specifically, in S30, the CPU 41 outputs a sound production command to the sound source 46, and outputs various parameters. Herein, the various parameters include the timbre control parameter for the sound source 46 to produce a sound in the case where the edge portion 16 is struck. Furthermore, the various parameters include the volume control parameter based on the output value of the vibration sensor 2 stored in the peak hold value memory 43*c*.

According to the sound source device 40 (struck position detector 40*a*) as described above, a struck position can be determined based on a timing at which the vibration sensor 2 reacts to the strike and a timing at which the pressure sensor 20 reacts to the strike in a certain period. Herein, "a certain period" in the present embodiment refers to a period of 3.2 msec being a holding period of the ring buffer 43*a*. If the pressure sensor 20 reacts to the strike earlier than the vibration sensor 2, the time difference calculated in S28 is a negative value. Thus, the time difference calculated in S28 is less than Tmin (positive value) that is determined based on a time difference between the vibration transmission time and the pressure transmission time. As a result, since it can be determined in the process of S29 that the edge portion 16 is struck, detection accuracy for the struck position can be improved.

When the edge portion 16 is struck, due to the time difference between the vibration transmission time and the pressure transmission time, sometimes the vibration sensor 2 reacts earlier than the pressure sensor 20. However, if the time difference calculated in S28 is less than Tmin, in the process of S29 it can be determined that the edge portion 16 is struck. As a result, erroneous detection of the struck position can be suppressed.

There is a case where, when a weak strike occurs on the edge portion 16, only the pressure sensor 20 reacts and the vibration sensor 2 does not react. In this case, sometimes, after a predetermined time (e.g., 1 sec) passes, the bell portion 12 or the bow portion 14 is struck, and only the vibration sensor 2 reacts. As a result, a time difference from when the pressure sensor 20 reacts before the predetermined time passes to when the vibration sensor 2 reacts after the predetermined time passes is calculated. Due to this, although the bell portion 12 or the bow portion 14 is struck, there is a risk that it may be determined that the edge portion 16 is struck. However, in the present embodiment, since the holding period of the ring buffer 43*a* is set to 3.2 msec, the output value of the pressure sensor 20 before 3.2 msec is overwritten. Hence, even in the above case, if the bell portion 12 or the bow portion 14 is struck, it can be determined that the bell portion 12 or the bow portion 14 is struck. Accordingly, by using the ring buffer 43*a*, erroneous detection of the struck position can be suppressed.

Herein, in the flowcharts in FIGS. 9 to 11, the process of S32, the process of S27 and the process of S29 respectively correspond to the first determination means, the second determination means and the third determination means described in the technical solutions.

Next, the second embodiment is explained with reference to FIGS. 12 to 17. In the first embodiment, the weight portion 32 is fixed to the pad 10 through the connection portion 34. Furthermore, the sound source device 40 (struck position detector 40*a*) includes the ring buffer 43*a*. In contrast, in the second embodiment, the weight portion 32 is adhered to the pressure sensor 20. Furthermore, the sound source device 40 (struck position detector 40*a*) includes, in place of the ring buffer 43*a*, a pressure sensor counter 63*b*. Moreover, the same parts as those in the first embodiment are denoted with the same reference numerals, and descriptions thereof are omitted in the following description.

Figure 12:
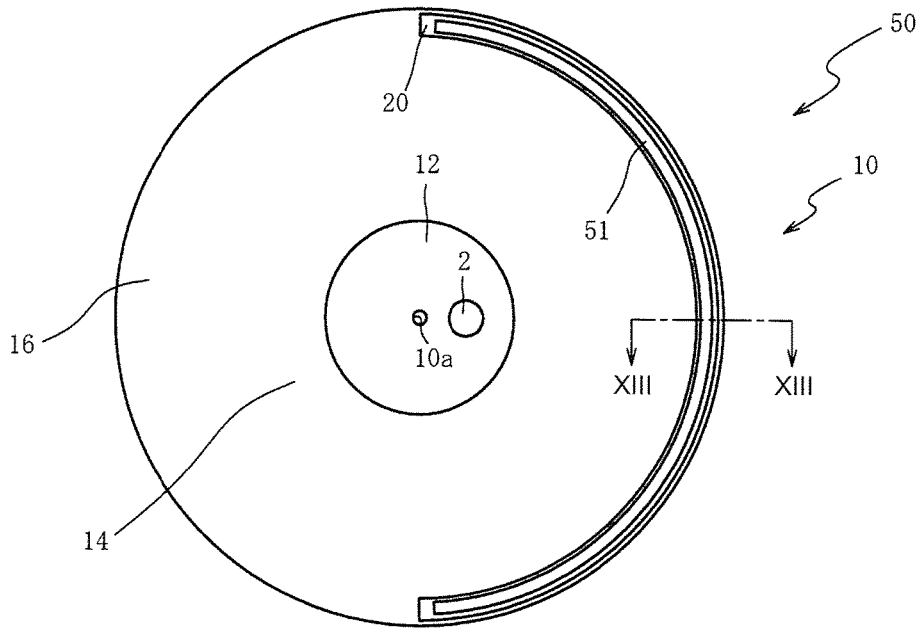
FIG. 12 is a bottom view of an electronic percussion instrument according to the second embodiment.
Figure 13:
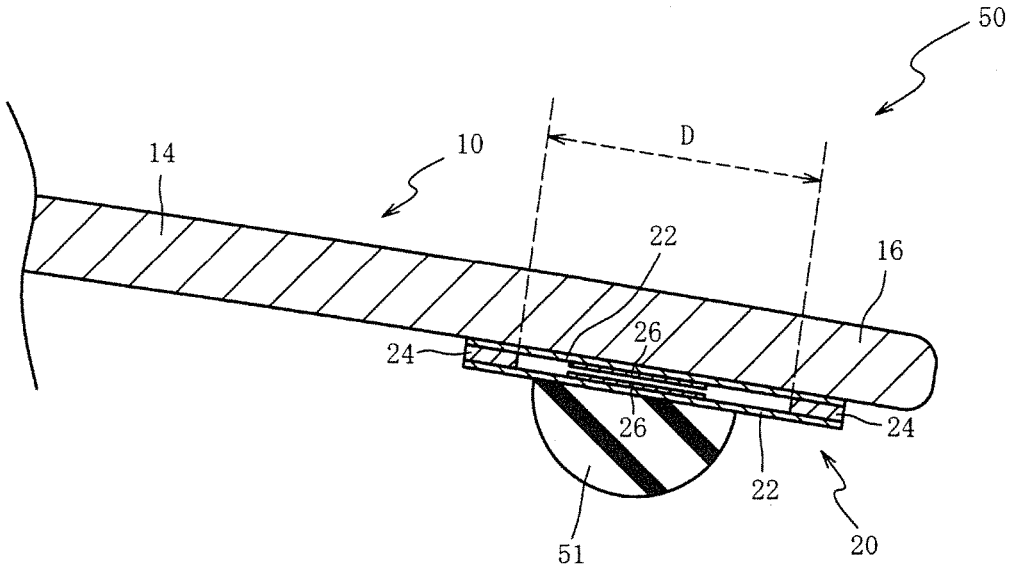
FIG. 13 is a cutaway end view of the electronic percussion instrument taken along line XIII-XIII in FIG. 12.

First, a weight portion 51 (weight member) of an electronic percussion instrument 50 is explained with reference to FIG. 12 and FIG. 13. FIG. 12 is a bottom view of the electronic percussion instrument 50 according to the second embodiment. FIG. 13 is a cutaway end view of the electronic percussion instrument 50 taken along line XIII-XIII in FIG. 12. As shown in FIG. 12 and FIG. 13, the electronic percussion instrument 50 includes the circular plate-like pad 10, the vibration sensor 2, the pressure sensor 20, and the weight portion 51 (weight member) that presses the pressure sensor 20.

The weight portion 51 is a member made of rubber having a hardness set to 70 degrees. The weight portion 51 is continuously provided in an arc shape in the circumferential direction of the edge portion 16 (pressure sensor 20) along the shape of the pressure sensor 20. The weight portion 51 is a member semicircular in cross section. The hardness of the rubber that forms the weight portion 51 is preferably not lower than 50 degrees (or higher than 50 degrees) and not higher than 90 degrees (or lower than 90 degrees). The hardness of the rubber that forms the weight portion 51 is more preferably not lower than 60 degrees (or higher than 60 degrees) and not higher than 80 degrees (or lower than 80 degrees). Moreover, the cross-sectional shape of the weight portion 51 is not limited to semicircular. For example, the cross-sectional shape may be polygonal or circular, arc-shaped, long circular, and elliptical, etc.

In the weight portion 51, a straight line side of the semicircular cross-sectional shape is adhered as a bottom surface to the front surface of the pressure sensor 20 in the deformable range D. The weight portion 51 configured in this manner has a simple structure, and can be easily installed onto the pressure sensor 20.

Since the weight portion 51 is adhered to the pressure sensor 20, when the pad 10 is struck, an inertial force acts on the weight portion 51 so that the weight portion 51 is able to press the pressure sensor 20. Even when a weak strike occurs on the edge portion 16, a predetermined inertial force acts on the weight portion 51. Thus, the pressure sensor 20 is able to detect a pressure change. Accordingly, while installation of the weight portion 51 can be facilitated and the structure of the weight portion 51 is simplified, the detection accuracy of the pressure sensor 20 for a strike can be improved.

Since the weight portion 51 is adhered to the pressure sensor 20 in the deformable range D, it can be prevented that the spacer 24 hinders deformation of the film 22 caused by the pressing by the weight portion 51. Since the pressure sensor 20 can be reliably pressed by the weight portion 51 in the deformable range D, the detection accuracy of the pressure sensor 20 for a strike can be further improved.

Since the weight portion 51 is a member made of rubber and is continuously provided in the circumferential direction of the edge portion 16, a part of the weight portion 51 in the circumferential direction can be elastically deformed. Since a part of the weight portion 51 on which the maximum inertial force acts is elastically deformed so as to press the pressure sensor 20, the detection accuracy of the pressure sensor 20 for a strike can be further improved. The lower the hardness of the rubber that forms the weight portion 51, the more easily the part of the weight portion 51 in the circumferential direction can be elastically deformed. Thus, by setting the hardness of the rubber that forms the weight portion 51 to not higher than 90 degrees to adjust the detection sensitivity of the pressure sensor 20, the detection accuracy of the pressure sensor 20 for a strike can be further improved.

Figure 14:
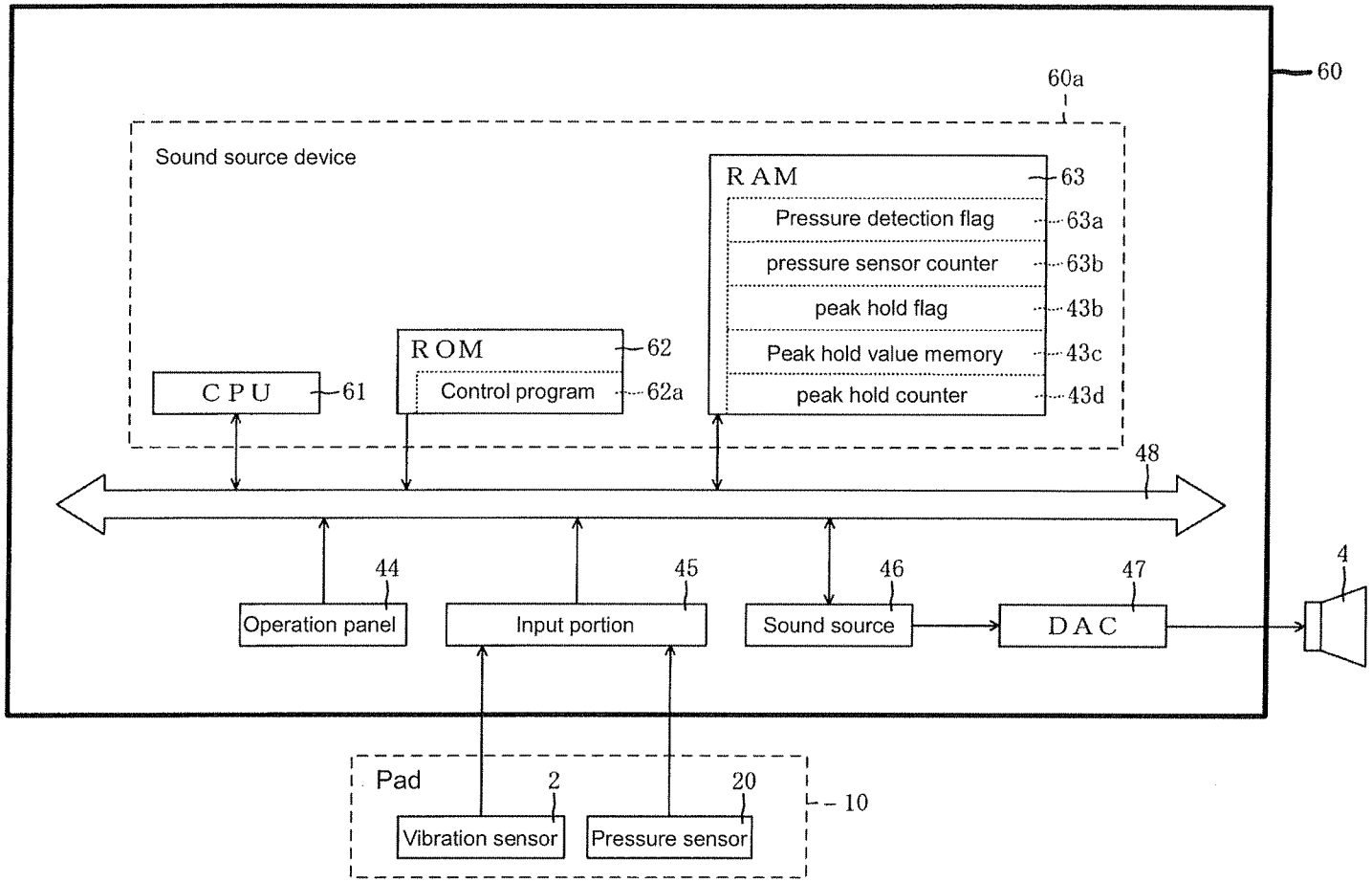
FIG. 14 is a block diagram showing an electric configuration of a sound source device.

Next, a sound source device 60 included in the electronic percussion instrument 50 is explained with reference to FIG. 14. FIG. 14 is a block diagram showing an electric configuration of the sound source device 60. The sound source device 60 includes a CPU 61, an ROM 62, an RAM 63, the operation panel 44, the input portion 45, the sound source 46, and the digital-to-analog converter (DAC) 47. Furthermore, the elements 44 to 47 and 61 to 63 are connected to one another through a bus line 48. Moreover, a struck position detector 60*a* included in the sound source device 60 includes the CPU 61, the ROM 62, and the RAM 63. The input portion 45 is connected to the vibration sensor 2 and the pressure sensor 20 that are installed on the pad 10.

The CPU 61 is a central control unit that controls each element of the sound source device 60 in accordance with fixed values or programs stored in the ROM 62, data stored in the RAM 63 and so on. The CPU 61 has built therein a timer (not illustrated) for counting a time by counting a clock signal.

Figure 15:
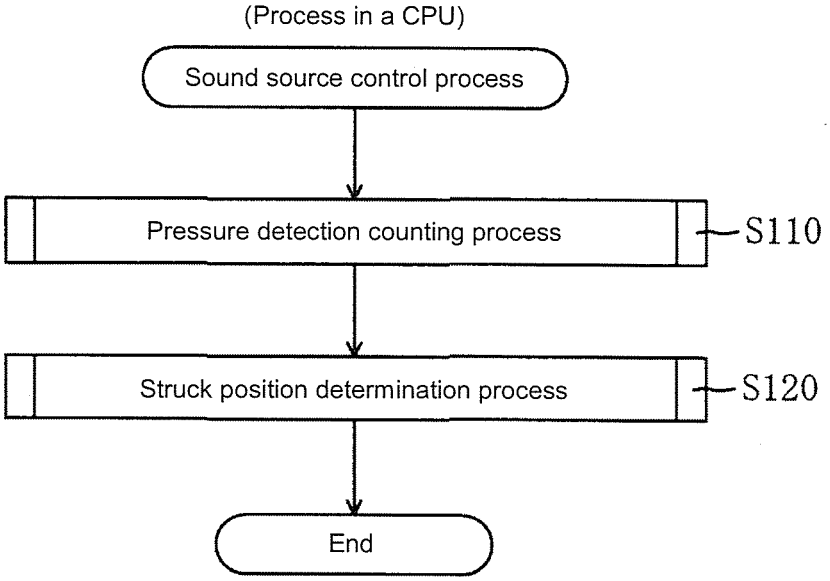
FIG. 15 is a flowchart showing a sound source control process.
Figure 16:
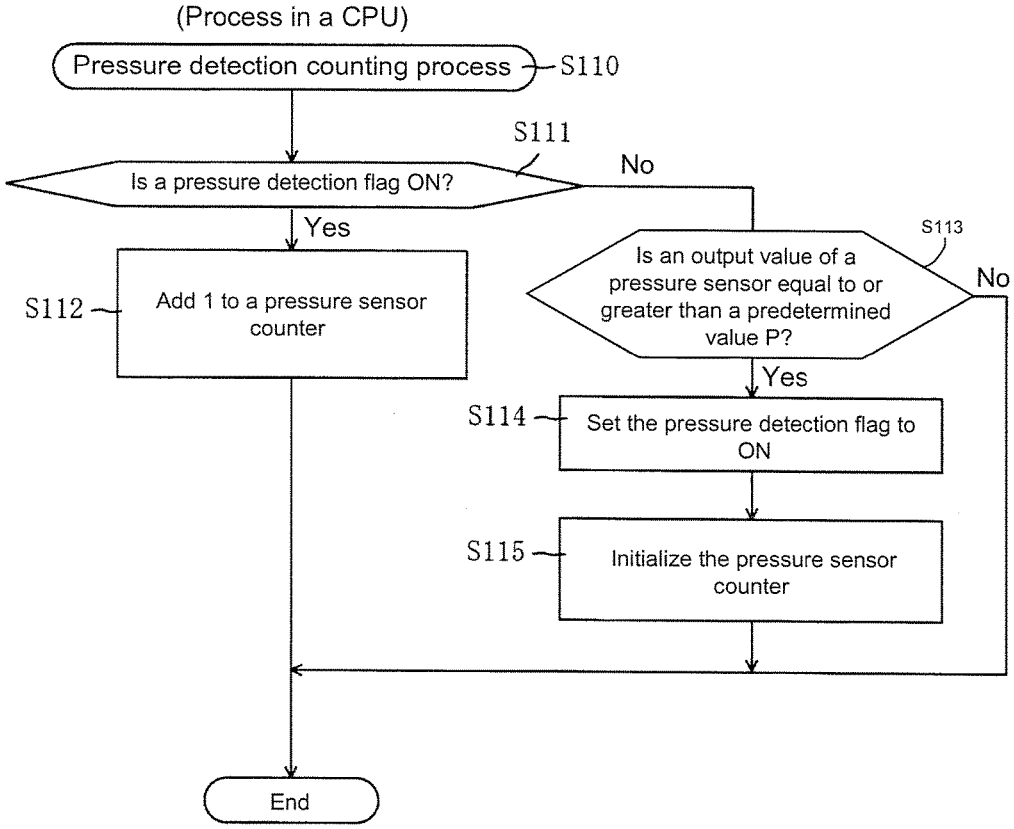
FIG. 16 is a flowchart showing a pressure detection counting process.
Figure 17:
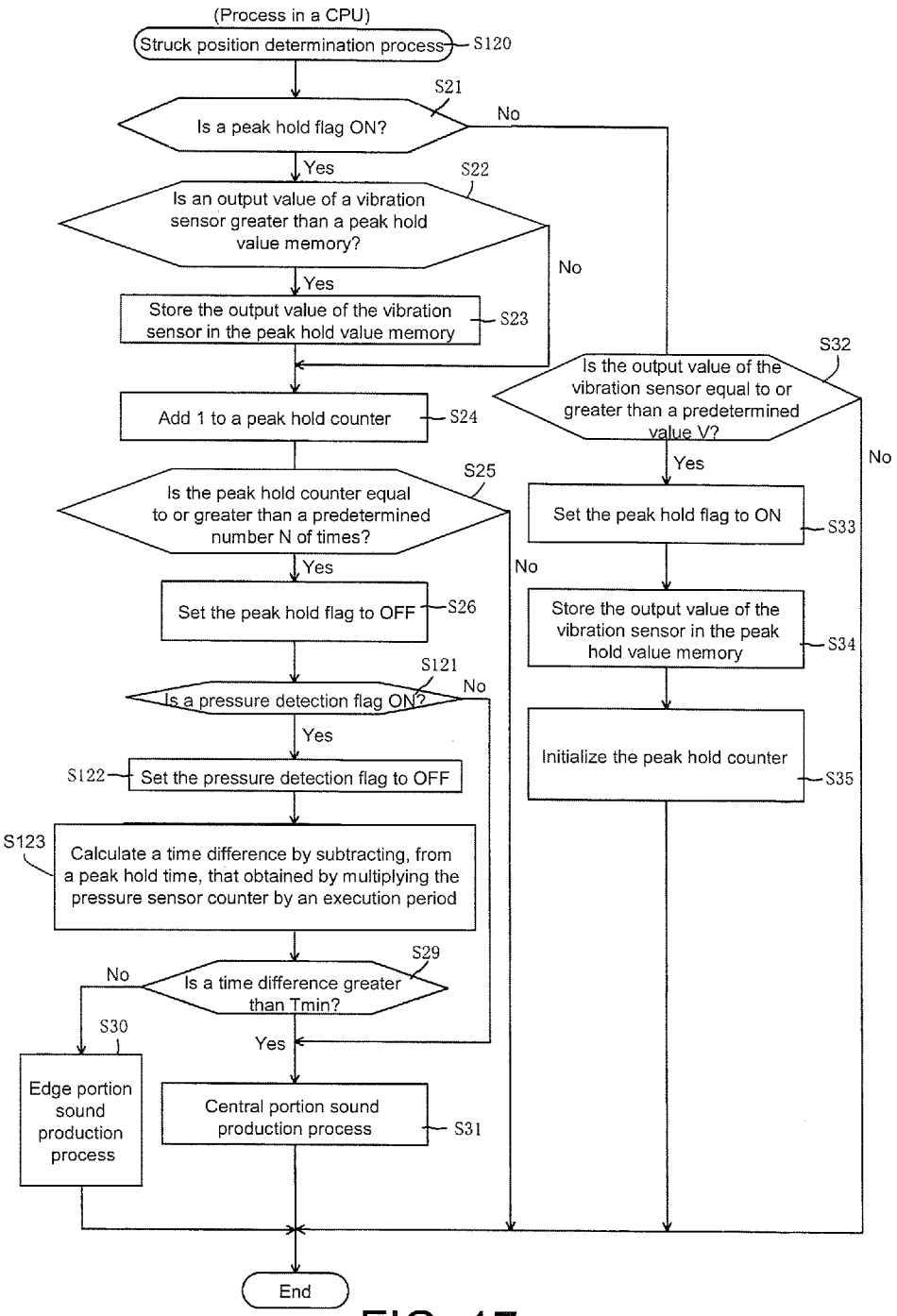
FIG. 17 is a flowchart showing a struck position determination process.

The ROM 62 is an unrewritable non-volatile memory. The ROM 62 stores a control program 62*a* executed by the CPU 61 or the sound source 46, or fixed value data (not illustrated) referred by the CPU 61 when the control program 62*a* is executed, etc. Moreover, the processes shown in the flowcharts in FIGS. 15 to 17 are executed based on the control program 62*a*.

The RAM 63 is a rewritable volatile memory. The RAM 63 has a temporary area for temporarily storing various data when the CPU 61 executes the control program 62*a*. In the temporary area, a pressure detection flag 63*a*, the pressure sensor counter 63*b*, the peak hold flag 43*b*, the peak hold value memory 43*c*, and the peak hold counter 43*d* are provided. Each of the above elements 43*b* to 43*d*, 63*a* and 63*b* provided in the RAM 63 is initialized when power is supplied to the sound source device 60.

The pressure detection flag 63*a* is a flag indicating whether or not the pressure sensor 20 has reacted to a strike, and whether or not time counting by the pressure sensor counter 63*b* is being performed. An initial state of the pressure detection flag 63*a* is set to OFF. Specifically, the pressure detection flag 63*a* is set to ON if the output value of the pressure sensor 20 has exceeded the predetermined value P. Furthermore, the pressure detection flag 63*a* is set to be turned off if it is ON after the time counting of the peak hold time Tp by the peak hold counter 43*d* has ended. Moreover, the predetermined value P is a threshold set with respect to the output value of the pressure sensor 20, and is a threshold for determining whether or not the output value of the pressure sensor 20 is based on noise.

The pressure sensor counter 63*b* is a counter counting time from when the pressure sensor 20 reacts to a strike to when the peak hold time Tp ends, and has an initial value set to 0. The pressure sensor counter 63*b* is initialized if the pressure sensor 20 reacts to a strike (the pressure detection flag 63*a* is set to ON), and is incremented by 1 at intervals of the execution period of the sound source control process. That is, the number of times the sound source control process has been performed since the pressure sensor 20 reacts to the strike is counted. After the pressure sensor counter 63*b* starts counting time, when the pressure detection flag 63*a* is set to OFF, the time counting is stopped.

Next, the processes executed by the CPU 61 of the sound source device 60 (struck position detector 60*a*) having the above configuration are explained with reference to FIG. 15, FIG. 16 and FIG. 17. FIG. 15 is a flowchart showing a sound source control process. FIG. 16 is a flowchart showing a pressure detection counting process. FIG. 17 is a flowchart showing a struck position determination process.

The sound source control process is periodically (every 400 μsec in the present embodiment) executed by a timer (not illustrated) built in the CPU 61 during while power is being supplied to the sound source device 60. As shown in FIG. 15, with respect to the sound source control process, the CPU 61 performs the pressure detection counting process (S110), then performs the struck position determination process (S120), and then ends the present process.

As shown in FIG. 16, with respect to the pressure detection counting process (S110), the CPU 61 determines whether or not the pressure detection flag 63*a* is ON (S111). In S111, if the CPU 61 determines that the pressure detection flag 63*a* is OFF (S111: No), the time counting by the pressure sensor counter 63*b* is not being performed. Accordingly, the CPU 61 determines whether or not the output value of the pressure sensor 20 is equal to or greater than the predetermined value P (threshold for determining whether or not the output value of the pressure sensor 20 is based on noise) (S113).

In S113, when the CPU 61 determines that the output value of the pressure sensor 20 is less than the predetermined value P (S113: No), the CPU 61 considers that the output value of the pressure sensor 20 is based on noise, and ends the present process. On the other hand, in S113, when the CPU 61 determines that the output value of the pressure sensor 20 is equal to or greater than the predetermined value P (S113: Yes), the CPU 61 considers that the output value of the pressure sensor 20 is based on striking. Next, the CPU 61 sets the pressure detection flag 63*a* to ON (S114), initializes the pressure sensor counter 63*b* in order to start the time counting by the pressure sensor counter 63*b* (S115), and ends the present process. Specifically, in S115, the CPU 61 sets the pressure sensor counter 63*b* to 0.

On the other hand, in S111, if the CPU 61 determines that the pressure detection flag 63*a* is ON (S111: Yes), the time counting by the pressure sensor counter 63*b* is being performed. Accordingly, the CPU 61 adds 1 to the pressure sensor counter 63*b* in order to cause the pressure sensor counter 63*b* to proceed (S112), and ends the present process.

As shown in FIG. 17, with respect to the struck position determination process (S120), the CPU 61 determines whether or not the pressure detection flag 63*a* is ON (S121) after executing the processes of S21 to S26. In S121, if the CPU 61 determines that the pressure detection flag 63*a* is OFF (S121: No), the pressure sensor 20 does not react to the strike. Accordingly, the CPU 61 determines that the bell portion 12 or the bow portion 14 (central portion) is struck and executes the process of S31, and ends the present process.

On the other hand, in S121, if the CPU 61 determines that the pressure detection flag 63*a* is ON (S121: Yes), the pressure sensor 20 reacts to the strike. Accordingly, the CPU 61 sets the pressure detection flag 63*a* to OFF (S122). By setting the pressure detection flag 63*a* to OFF, the time counting by the pressure sensor counter 63*b* ends, and the CPU 61 is prepared to be able to determine that the pressure sensor 20 reacts to a strike in the subsequent processes.

Next, the CPU 61 calculates a time difference by subtracting, from the peak hold time Tp, a value obtained by multiplying the pressure sensor counter 63*b* by an execution period (S123). In S123, the value obtained by multiplying the pressure sensor counter 63*b* by the execution period refers to a time from when the pressure sensor 20 reacts to a strike to the present time point. Moreover, the time difference calculated in S123 indicates a time difference between when the time counting of the peak hold time Tp is started (the vibration sensor 2 reacts to the strike) and when the pressure sensor 20 reacts to the strike. Although the method for calculating the time difference differs between the present embodiment and the first embodiment, the time difference calculated in S123 of the present embodiment and the time difference calculated in S28 of the first embodiment are the same. Next, the CPU 61 executes the process of S29 based on the time difference calculated in S123, executes the process of S30 or S31 based on a result of the process of S29, and ends the present process.

According to the sound source device 60 (struck position detector 60*a*) as described above, a struck position can be determined based on the timing at which the vibration sensor 2 reacts to the strike and the timing at which the pressure sensor 20 reacts to the strike in a certain period. If the pressure sensor 20 reacts to the strike earlier than the vibration sensor 2, the time difference calculated in S123 is a negative value. Thus, the time difference calculated in S123 is less than Tmin (positive value) that is determined based on the time difference between the vibration transmission time and the pressure transmission time. Accordingly, since it can be determined in the process of S29 that the edge portion 16 is struck, the detection accuracy for the struck position can be improved. Moreover, the "certain period" refers to a time obtained by adding approximately 1 msec (time by which the pressure sensor 20 can be expected to react to the strike earlier than the vibration sensor 2) to the peak hold time Tp being 2 msec.

When the edge portion 16 is struck, due to the time difference between the vibration transmission time and the pressure transmission time, sometimes the vibration sensor 2 reacts earlier than the pressure sensor 20. However, if the time difference calculated in S123 is less than Tmin, in the process of S29 it can be determined that the edge portion 16 is struck. As a result, erroneous detection of the struck position can be suppressed.

There is a case where, when a weak strike occurs on the edge portion 16, only the pressure sensor 20 reacts and the vibration sensor 2 does not react. In this case, sometimes, after a predetermined time (e.g., 1 sec) passes, the bell portion 12 or the bow portion 14 is struck, and only the vibration sensor 2 reacts. As a result, the time difference from when the pressure sensor 20 reacts before the predetermined time passes to when the vibration sensor 2 reacts after the predetermined time passes is calculated. Due to this, although the bell portion 12 or the bow portion 14 is struck, there is a risk that it may be determined that the edge portion 16 is struck.

To prevent this, in the present embodiment, between the process of S122 and the process of S123, a process may also be provided that determines whether or not the pressure sensor counter 63*b* is equal to or greater than a predetermined number (number corresponding to approximately 3 msec) of times. If it is determined by this process that the pressure sensor counter 63*b* is equal to or greater than the predetermined number of times, the processes of S123 and S29 are skipped and the process of S31 is executed, and then the present process is ended. Herein, "the pressure sensor counter 63*b* is equal to or greater than the predetermined number of times" means that 3 msec or more have passed since the reaction of the pressure sensor 20. On the other hand, if it is determined that the pressure sensor counter 63*b* is less than the predetermined number of times, the processes of S123 and S29 are executed, then the process of S30 or S31 is executed based on the result of the process of S29, and then the present process is ended. Herein, "the pressure sensor counter 63*b* is less than the predetermined number of times" means that 3 msec or more have not passed since the reaction of the pressure sensor 20. Accordingly, when a weak strike occurs on the edge portion 16, even in the case where only the pressure sensor 20 reacts and the vibration sensor 2 does not react, if the bell portion 12 or the bow portion 14 is struck, it can be determined that the bell portion 12 or the bow portion 14 is struck. As a result, erroneous detection can be prevented.

Herein, in the flowcharts in FIGS. 15 to 17, the process of S32, the process of S121 and the process of S29 respectively correspond to the first determination means, the second determination means and the third determination means described in the technical solutions.

Figure 18:
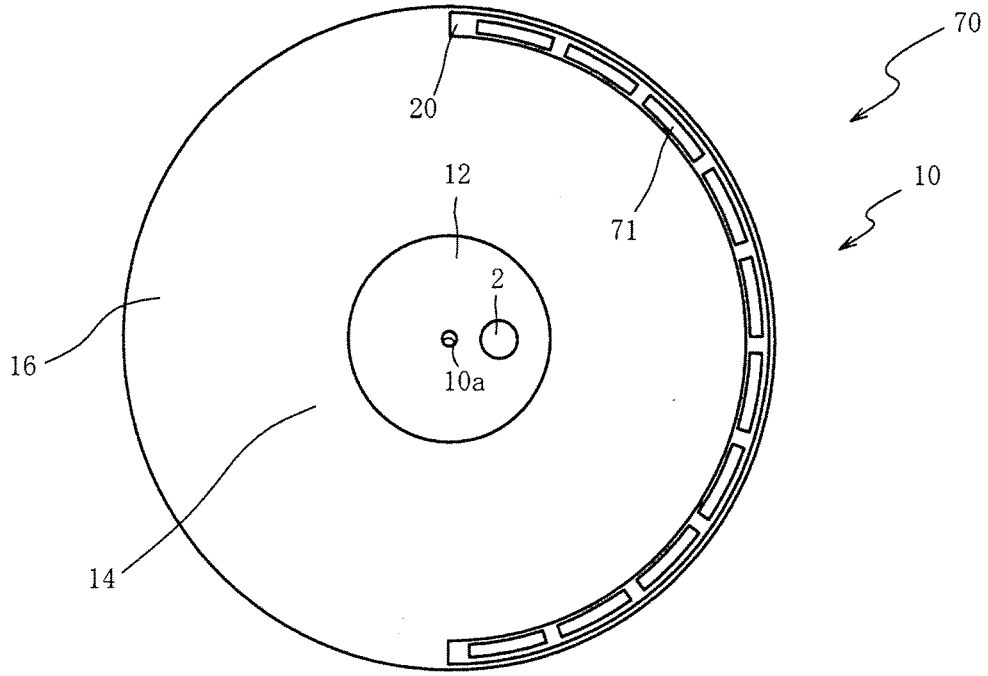
FIG. 18 is a bottom view of an electronic percussion instrument according to the third embodiment.

Next, the third embodiment is explained with reference to FIG. 18. In the second embodiment, the weight portion 51 is continuously provided in the circumferential direction of the edge portion 16. In contrast, in the third embodiment, a weight portion 71 is intermittently provided in the circumferential direction of the edge portion 16. Moreover, the same parts as those in the first and the second embodiments are denoted with the same reference numerals, and descriptions thereof are omitted in the following description. FIG. 18 is a bottom view of an electronic percussion instrument 70 according to the third embodiment. As shown in FIG. 18, the electronic percussion instrument 70 includes the circular plate-like pad 10, the vibration sensor 2, the pressure sensor 20, and the weight portion 71 (weight member) that presses the pressure sensor 20.

The weight portion 71 is made of rubber having a hardness set to 70 degrees, and is a member semicircular in cross section, intermittently provided in the circumferential direction of the edge portion 16 (pressure sensor 20) along the shape of the pressure sensor 20. Moreover, the cross-sectional shape of the weight portion 71 is not limited to semicircular and may be properly changed. In the weight portion 71, a straight line side of the semicircular cross-sectional shape is adhered as a bottom surface to the front surface of the pressure sensor 20 in the deformable range D. The weight portion 71 configured in this manner has a simple structure, and can be easily installed onto the pressure sensor 20.

Since the weight portion 71 is adhered to the pressure sensor 20, when the pad 10 is struck, an inertial force acts on the weight portion 71 so that the weight portion 71 is able to press the pressure sensor 20. If the weight portion 71 is continuously provided in the circumferential direction of the edge portion 16, when a part of the weight portion 71 is about to be elastically deformed, the part of the weight portion 71 is pulled by the surrounding weight portion 71 and the elastic deformation thereof is hindered. On the other hand, in the present embodiment, since the weight portion 71 is intermittently provided, it can be suppressed that deformation of a part of the weight portion 71 on which the maximum inertial force acts is hindered by the weight portion 71 adjacent thereto. Accordingly, compared to the case where the weight portion 71 is continuously provided in the circumferential direction of the edge portion 16, the detection accuracy of the pressure sensor 20 for a strike can be improved.

In addition, since the weight portion 71 is intermittently provided, even if a part of the weight portion 71 cannot be elastically deformed, the inertial force acts on the part of the weight portion 71 so that the weight portion 71 presses the pressure sensor 20, and reduction in detection sensitivity of the pressure sensor 20 can be suppressed. Hence, the weight portion 71 is not necessarily made of rubber, and it is also possible to use the weight portion 71 made of synthetic resin or metal. In such case, since specific gravity of the weight portion 71 can be increased, the inertial force acting on the weight portion 71 can be increased. As a result, while reduction in detection sensitivity of the pressure sensor 20 is suppressed, since the pressing force toward the pressure sensor 20 caused by the inertial force acting on the weight portion 71 can be increased, the detection accuracy of the pressure sensor 20 for a strike can be further improved.

Figure 19:
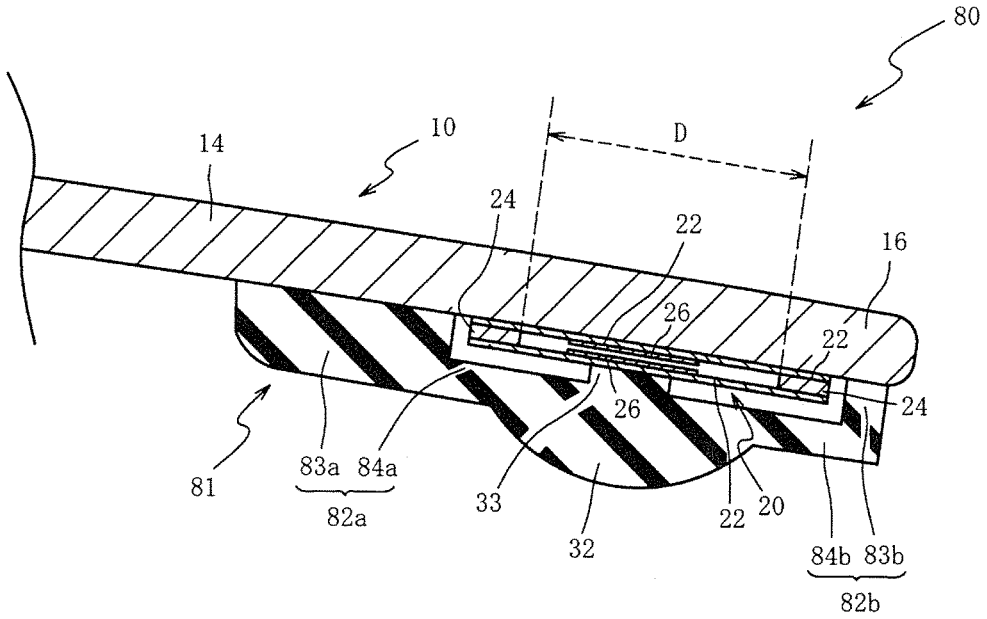
FIG. 19 is a cutaway end view of an electronic percussion instrument according to the fourth embodiment.

Next, the fourth embodiment is explained with reference to FIG. 19. In the first embodiment, the connection portion 34 that is fixed to the pad 10 at the position closer to the bell portion 12 than the pressure sensor 20 is connected to the weight portion 32. In contrast, in the fourth embodiment, in addition to a first connection portion 82*a*, a second connection portion 82*b* is also connected to the weight portion 32. Herein, the first connection portion 82*a* is fixed to the pad 10 at a position closer to the bell portion 12 than the pressure sensor 20. On the other hand, the second connection portion 82*b* is fixed to the pad 10 at a position closer to the outer circumferential end of the pad 10 than the pressure sensor 20. Moreover, the same parts as those in the first embodiment are denoted with the same reference numerals, and descriptions thereof are omitted in the following description. FIG. 19 is a cutaway end view of an electronic percussion instrument 80 according to the fourth embodiment. As shown in FIG. 19, the electronic percussion instrument 80 includes the circular plate-like pad 10, the vibration sensor 2 (not illustrated), the pressure sensor 20, and a weight member 81 that presses the pressure sensor 20.

The weight member 81 is a member made of rubber having a hardness set to 70 degrees, and is continuously provided in an arc shape in the circumferential direction of the edge portion 16 (pressure sensor 20) along the shape of the pressure sensor 20. The weight member 81 includes the weight portion 32, the first connection portion 82*a* and the second connection portion 82*b*. The weight portion 32 nonadhesively contacts the front surface of the pressure sensor 20 in the deformable range D. The first connection portion 82*a* is adhered and fixed to the pad 10 at the position closer to the bell portion 12 than the pressure sensor 20, and is connected to the weight portion 32. The second connection portion 82*b* is adhered and fixed to the pad 10 at the position closer to the outer circumferential end of the pad 10 than the pressure sensor 20, and is connected to the weight portion 32. The weight portion 32, the first connection portion 82*a* and the second connection portion 82*b* are provided over a circumferential direction of the weight member 81.

The first connection portion 82*a* includes a first thick-walled portion 83*a* and a first thin-walled portion 84*a*. The first thick-walled portion 83*a* substantially vertically extends from the back surface of the pad 10. The first thin-walled portion 84*a* extends from the first thick-walled portion 83*a* outward in the radial direction of the weight member 81, and is connected to the weight portion 32. Furthermore, the first thin-walled portion 84*a* is smaller in thickness (dimension in the facing direction of the film 22) than the first thick-walled portion 83*a*. The second connection portion 82*b* includes a second thick-walled portion 83*b* and a second thin-walled portion 84*b*. The second thick-walled portion 83*b* substantially vertically extends from the back surface of the pad 10. The second thin-walled portion 84*b* extends from the second thick-walled portion 83*b* inward in the radial direction of the weight member 81, and is connected to the weight portion 32. Furthermore, the second thin-walled portion 84*b* is smaller in thickness than the second thick-walled portion 83*b*.

When the pad 10 is struck, the inertial force acts on the weight portion 32, so as to press the pressure sensor 20. Due to the first thin-walled portion 84*a* and the second thin-walled portion 84*b*, the first connection portion 82*a* and the second connection portion 82*b* can respectively be easily deformed by bending. Thus, it can be suppressed that the first connection portion 82*a* and the second connection portion 82*b* reduce the pressing force toward the pressure sensor 20 caused by the inertial force acting on the weight portion 32. As a result, the detection accuracy of the pressure sensor 20 for a strike can be improved.

The first thin-walled portion 84*a* and the second thin-walled portion 84*b* are provided respectively on a radially outer side and a radially inner side of the weight portion 32. Thus, the pressure sensor 20 can be covered by the weight member 81 over the circumferential direction of the pressure sensor 20. Accordingly, while the pressure sensor 20 is protected by the weight member 81, the detection accuracy of the pressure sensor 20 for a strike can be improved. In addition, in the weight member 81, the radially outer side and the radially inner side of the weight portion 32 are supported by the first connection portion 82*a* and the second connection portion 82*b*. Thus, compared to the weight member 30 in the cantilever state in the first embodiment, the rubber that forms the weight member 81 can be made resistant to fatigue (weakening in elasticity/deformation). Accordingly, the weight member 81 can be improved in durability.

Figure 20:
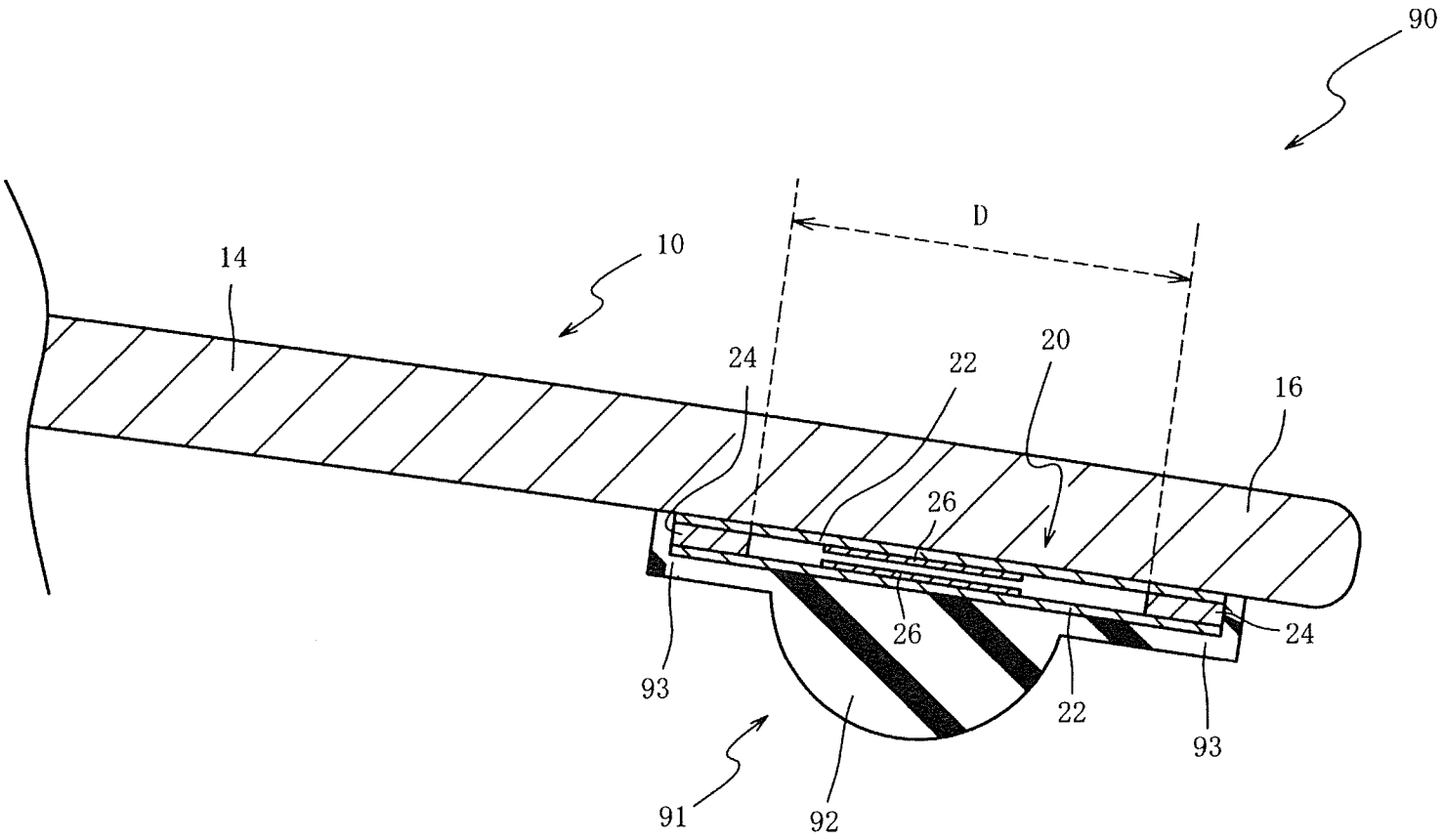
FIG. 20 is a cutaway end view of an electronic percussion instrument according to the fifth embodiment.

Next, the fifth embodiment is explained with reference to FIG. 20. In the second embodiment, the weight portion 51 (weight member) is adhered to the pressure sensor 20 in the deformable range D. In contrast, in the fifth embodiment, a weight member 91 is adhered to the pressure sensor 20 so that the pressure sensor 20 is covered by the weight member 91. Moreover, the same parts as those in the first and the second embodiments are denoted with the same reference numerals, and descriptions thereof are omitted in the following description. FIG. 20 is a cutaway end view of an electronic percussion instrument 90 according to the fifth embodiment. As shown in FIG. 20, the electronic percussion instrument 90 includes the circular plate-like pad 10, the vibration sensor 2 (not illustrated), the pressure sensor 20, and the weight member 91 that presses the pressure sensor 20.

The weight member 91 is a member made of rubber having a hardness set to 70 degrees. The weight member 91 is continuously provided in an arc shape in the circumferential direction of the edge portion 16 (pressure sensor 20) along the shape of the pressure sensor 20. The weight member 91 includes a weight portion 92 and a coating portion 93. The weight portion 92 is adhered to the front surface of the pressure sensor 20 in the deformable range D. The weight portion 92 is formed semicircular in cross section. The coating portion 93 extends from the weight portion 92 and is adhered to the pressure sensor 20 to cover the pressure sensor 20. Furthermore, the coating portion 93 is formed into a film shape thinner than the pressure sensor 20. The weight portion 92 and the coating portion 93 are provided over a circumferential direction of the weight member 91.

Since the pressure sensor 20 can be covered by the weight member 91, the pressure sensor 20 can be protected by the weight member 91. In addition, since the weight portion 92 is semicircular in cross section (and expands so as to be away from the pressure sensor 20), an inertial force acts on the weight portion 92 so that the weight portion 92 is able to press the pressure sensor 20. Since the coating portion 93 has a film shape thinner than the pressure sensor 20, it can be suppressed that deformation of the film 22 is hindered. As a result, while the pressure sensor 20 is protected by the weight member 91, the detection accuracy of the pressure sensor 20 for a strike can be improved.

The above illustrates the invention on the basis of the embodiments. However, it is easily understood that the invention is not limited to any of the above embodiments, and various modifications or alterations may be made without departing from the spirit of the invention. For example, in the above embodiments, the electronic percussion instruments 1, 50, 70, 80 and 90 are electronic percussion instruments simulating acoustic cymbals. However, the invention is not limited thereto. It is certainly possible to use an electronic percussion instrument simulating an acoustic hi-hat cymbal. In this case, the weight member (weight portion) is provided on an upper pad, and the shape or position of the weight member (weight portion) is adjusted so that the weight member (weight portion) does not contact a lower pad. For example, the weight member (weight portion) may be made thinner, or the weight member (weight portion) may be provided closer to the bell portion than in the above embodiments.

In the above embodiments, the vibration sensor 2 is a piezo sensor, and the pressure sensor 20 is a sheet-like membrane switch. However, the invention is not limited thereto. It is certainly possible to use other sensors capable of detecting vibration as the vibration sensor, and to use other sensors capable of detecting a pressure change as the pressure sensor. For example, examples of the sensors other than piezo sensors that are capable of detecting vibration include piezoelectric sensors or electrodynamic sensors, and capacitance type sensors, etc. In addition, the sensors other than sheet-like membrane switches that are capable of detecting a pressure change are exemplified by conductive rubber sensors or cable sensors, etc.

In the above embodiments, the weight members 30, 81 and 91 (weight portions 51 and 71) are members made of rubber. However, the invention is not limited thereto. It is certainly possible to use, for a material of the weight member (weight portion), synthetic resin such as a thermoplastic elastomer having elasticity or the like. In addition, the weight members 30 and 81 in the above first and fourth embodiments do not have to be entirely made of rubber. It is possible to use a connection portion made of rubber or of synthetic resin such as a thermoplastic elastomer having elasticity or the like and a weight member including a weight portion made of metal.

In the above embodiments, the pad 10 is a member made of bronze. However, the invention is not limited thereto. It is certainly possible to use a pad made of a metal other than bronze, or a pad made of a non-metal such as synthetic resin and so on. In addition, it is also possible to cover from the front surface of the pad to at least the edge portion on the back surface with rubber or synthetic resin, etc. If a material that covers the pad is the same as a material that forms the weight member, it is also possible to use a portion of the material that covers the pad as the weight member.

In the above embodiments, the pressure sensor 20 is provided in an arc shape over the half circumference of the back surface of the edge portion 16 on the player side. However, the invention is not limited thereto. It is also possible to provide the pressure sensor on the whole circumference of the back surface of the edge portion 16, or to provide the pressure sensor on a portion of the back surface of the edge portion 16. In addition, it is also possible to intermittently provide the pressure sensor along the circumferential direction of the edge portion 16. By providing an electrode and a spacer in an alternate manner along the circumferential direction of the pressure sensor, it is also possible to intermittently provide a part of the pressure sensor that detects a pressure change. In addition, it is also possible to provide the weight member (weight portion) all over the part where the pressure sensor is provided, or to provide the weight member (weight portion) on a portion of the part where the pressure sensor is provided. In addition, if the pressure sensor 20 is provided in an arc shape over the half circumference of the back surface of the edge portion 16 on the player side, a mass body that balances the weight of the pressure sensor and the weight member (weight portion) may be disposed. In this manner, weight balance between front and rear of the pad is maintained, and natural swinging of the pad can be ensured. The mass body has an arbitrary shape. However, the mass body is desirably formed in an arc shape over the half circumference of the back surface of the edge portion 16 opposite the half circumference of the back surface of the edge portion 16 where the pressure sensor 20 is disposed. The mass body may include the same material as that of the weight member (weight portion). In addition, the mass body may be formed integrally with the pad by thickening a portion of the pad.

In the above first and fourth embodiments, the connection portion 34 (first connection portion 82*a* and second connection portion 82*b*) is provided over the circumferential direction of the weight member 30 or 81 (continuously in the circumferential direction of the edge portion 16). However, the invention is not limited thereto. It is certainly possible to intermittently provide the connection portion 34 (first connection portion 82*a* and second connection portion 82*b*) in the circumferential direction of the edge portion 16. Accordingly, the connection portion 34 (first connection portion 82*a* and second connection portion 82*b*) can be easily deformed by bending. In addition, it is also possible to intermittently provide either of the thick-walled portion 35 (first thick-walled portion 83*a* and second thick-walled portion 83*b*) and the thin-walled portion 36 (first thin-walled portion 84*a* and second thin-walled portion 84*b*) in the circumferential direction of the edge portion 16.

In the above first and fourth embodiments, the connection portion 34 (first connection portion 82*a* and second connection portion 82*b*) is adhered and fixed to the pad 10. However, the invention is not limited thereto. For fixing between the pad 10 and the connection portion, it is certainly possible to use a fitting mechanism or a bolt, a rivet or the like. For fixing between the pad 10 and the mass body, not only adhesion, but also a fitting mechanism or a bolt, a rivet or the like can be used.

In the above first and second embodiments, in the processes executed by the CPUs 41 and 61 of the sound source devices 40 and 60 (struck position detectors 40*a* and 60*a*), whether the central portion or the edge portion 16 is struck is determined. Herein, the central portion includes the bell portion 12 and the bow portion 14. However, the invention is not limited thereto. It is certainly possible to provide a process determining which of the bell portion 12 and the bow portion 14 in the central portion is struck. In this case, it is also possible to provide another sensor different from the vibration sensor 2 and the pressure sensor 20, and to provide a process based on an output value of the another sensor.

In the above first and second embodiments, in the processes executed by the CPUs 41 and 61, when it is determined that the output value of the vibration sensor 2 is equal to or greater than the predetermined value V, it is considered that the vibration sensor 2 reacts to a strike. However, the invention is not limited thereto. It is also possible to add other processes. For example, it is possible to provide a process that detects the shape of the waveform of the output value of the vibration sensor 2 so as to determine whether the waveform is based on noise or based on striking. Moreover, similarly, in the process determining whether or not the pressure sensor 20 has reacted to a strike, it is possible to provide other processes in addition to the process determining whether or not the output value of the pressure sensor 20 is equal to or greater than the predetermined value P.

Moreover, the sound source devices 40 and 60 (struck position detectors 40*a* and 60*a*) of the above first and second embodiments are applicable to various electronic percussion instruments that include a vibration sensor and a pressure sensor. The sound source devices 40 and 60 (struck position detectors 40*a* and 60*a*) are applicable to, not only the electronic percussion instrument of the invention, but also other electronic percussion instruments in which the timing at which the vibration sensor reacts differs from the timing at which the pressure sensor reacts according to the struck position. For example, an electronic percussion instrument may be mentioned in which no weight portion is provided, and in a pair of films of a membrane switch as the pressure sensor, the pressure sensor reacts to a strike due to a relatively small inertial force acting on the film which is separate from the edge portion 16.

In addition, it is possible to combine a portion or all of each of the above embodiments with a portion or all of another embodiment. In addition, it is also possible to omit a portion of the configuration of each of the above embodiments. For example, it is certainly possible to apply the weight portion 71 (weight member) intermittently provided in the circumferential direction of the edge portion 16 in the above third embodiment to the weight portion (weight member) in the above first, fourth and fifth embodiments. When the weight portion 71 (weight member) in the above third embodiment is applied to the above first and fourth embodiments, sometimes the connection portion and the weight portion are intermittently provided, and sometimes the weight portion is intermittently provided on the continuously provided connection portion. In addition, it is certainly possible to omit the first connection portion 82*a* in the above fourth embodiment and to support the weight portion 32 only by the second connection portion 82*b*. In addition, it is also possible that the sound source device 40 in the above first embodiment and the sound source device 60 in the above second embodiment are respectively replaced. In addition, the sound source device 40 in the above first embodiment and the sound source device 60 in the above second embodiment can respectively be used in the electronic percussion instruments 70, 80 and 90 in the above third, fourth and fifth embodiments.

What is claimed is:

1. An electronic percussion instrument, comprising a plate-like pad, having a front surface to be struck;

a sheet-like pressure sensor, provided on a back surface of an outer circumferential end portion of the pad and detecting a pressure change; and a weight portion, contacting a front surface of the pressure sensor, wherein due to striking on the front surface of the pad, an inertial force from the front surface of the pressure sensor toward a back surface of the pad acts on the weight portion, and the weight portion presses the pressure sensor.

2. The electronic percussion instrument according to claim 1, comprising a connection portion formed of an elastic material, the connection portion being fixed to the pad at a position closer to at least one of an outer circumferential end and a center of the pad than the pressure sensor and connected to the weight portion, wherein the weight portion is nonadhesive to the pressure sensor.

3. The electronic percussion instrument according to claim 2, wherein the connection portion comprises a thick-walled portion, substantially vertically extending from the back surface of the pad; and a thin-walled portion smaller in thickness than the thick-walled portion, extending from the thick-walled portion toward the weight portion and connected to the weight portion.

4. The electronic percussion instrument according to claim 3, wherein the connection portion is fixed to the pad at the position closer to the center of the pad than the pressure sensor and is connected to the weight portion.

5. The electronic percussion instrument according to claim 2, wherein the elastic material has a hardness set in a range of 50 degrees to 90 degrees.

6. The electronic percussion instrument according to claim 2, wherein the weight portion further comprises a protrusion portion contacting the pressure sensor in a deformable range, the protrusion portion protrudes toward the pressure sensor with a width smaller than the deformable range, and the weight portion is formed expanding toward an opposite side of the protrusion portion so as to be away from the pressure sensor.

7. The electronic percussion instrument according to claim 1, wherein the pressure sensor extends along an outer circumference of the pad, and the weight portion is formed of an elastic material continuously provided along a shape of the pressure sensor and is adhered to the front surface of the pressure sensor.

8. The electronic percussion instrument according to claim 1, wherein the pressure sensor extends along an outer circumference of the pad, and the weight portion is intermittently provided along a shape of the pressure sensor.

9. The electronic percussion instrument according to claim 2, wherein the connection portion comprises a first connection portion, adhered and fixed to the pad at the position closer to the center of the pad than the pressure sensor, and connected to the weight portion; and a second connection portion, adhered and fixed to the pad at the position closer to the outer circumferential end of the pad than the pressure sensor, and connected to the weight portion.

10. The electronic percussion instrument according to claim 9, wherein the first connection portion comprises a first thick-walled portion, substantially vertically extending from the back surface of the pad; and a first thin-walled portion smaller in thickness than the first thick-walled portion, extending from the first thick-walled portion toward the outer circumferential end of the pad and connected to the weight portion, and the second connection portion comprises a second thick-walled portion, substantially vertically extending from the back surface of the pad; and a second thin-walled portion smaller in thickness than the second thick-walled portion, extending from the second thick-walled portion toward the center of the pad and connected to the weight portion.

11. The electronic percussion instrument according to claim 9, wherein the weight portion further comprises a protrusion portion contacting the pressure sensor in a deformable range, the protrusion portion protrudes toward the pressure sensor with a width smaller than the deformable range, and the weight portion is formed expanding toward an opposite side of the protrusion portion so as to be away from the pressure sensor.

12. The electronic percussion instrument according to claim 7, wherein the elastic material has a hardness set in a range of 50 degrees to 90 degrees.

13. The electronic percussion instrument according to claim 1, comprising a struck position detector comprising:

a processor, configured for:

determining whether a first output value being an output value of a vibration sensor that is provided on a central portion of the pad and that detects a vibration of the pad is equal to or greater than a first predetermined value;

determining whether a second output value being an output value of the pressure sensor is equal to or greater than a second predetermined value; and determining that the outer circumferential end portion is struck if, in a certain period, the pressure sensor outputs the second output value being equal to or greater than the second predetermined value before a timing at which the vibration sensor outputs the first output value being equal to or greater than the first predetermined value.

14. The electronic percussion instrument according to claim 13, wherein the processor determines that the outer circumferential end portion is struck if a time from when the vibration sensor outputs the first output value being equal to or greater than the first predetermined value until when the pressure sensor outputs the second output value being equal to or greater than the second predetermined value is equal to or less than a threshold.

15. The electronic percussion instrument according to claim 13, wherein the processor determines that the central portion is struck if a time, from when the vibration sensor outputs the first output value being equal to or greater than the first predetermined value until when the pressure sensor outputs the second output value being equal to or greater than the second predetermined value, is greater than a threshold.

16. The electronic percussion instrument according to claim 13, wherein the processor determines that the central portion is struck if the first output value is equal to or greater than the first predetermined value and a maximum value in the second output value is less than the second predetermined value.

17. The electronic percussion instrument according to claim 13, comprising a sound source device for detecting a struck position by the struck position detector based on the output values of the vibration sensor and the pressure sensor so as to produce a musical sound.

18. The electronic percussion instrument according to claim 1, comprising a struck position detector comprising:

a processor, configured for:

determining whether a first output value being an output value of a vibration sensor that is provided on a central portion of the pad and that detects a vibration of the pad is equal to or greater than a first predetermined value;

determining whether or not the pressure sensor has reacted to the strike; and determining that the outer circumferential end portion is struck if, in a certain period, the pressure sensor has reacted to the strike before a timing at which the vibration sensor outputs the first output value being equal to or greater than the first predetermined value.

* * * * *